US009393825B2

(12) United States Patent
Sakamoto et al.

(10) Patent No.: US 9,393,825 B2
(45) Date of Patent: Jul. 19, 2016

(54) INTERMEDIATE TRANSFER MEDIUM

(71) Applicant: DAI NIPPON PRINTING CO., LTD., Tokyo (JP)

(72) Inventors: Kano Sakamoto, Tokyo (JP); Shinya Yoda, Tokyo (JP)

(73) Assignee: DAI NIPPON PRINTING CO., LTD., Tokyo (JP)

( * ) Notice: Subject to any disclaimer, the term of this patent is extended or adjusted under 35 U.S.C. 154(b) by 0 days.

(21) Appl. No.: 14/380,379

(22) PCT Filed: Feb. 26, 2013

(86) PCT No.: PCT/JP2013/054996
§ 371 (c)(1),
(2) Date: Aug. 22, 2014

(87) PCT Pub. No.: WO2013/129415
PCT Pub. Date: Sep. 6, 2013

(65) Prior Publication Data

US 2015/0328913 A1 Nov. 19, 2015

(30) Foreign Application Priority Data

Feb. 29, 2012 (JP) ..... 2012-044526
Feb. 29, 2012 (JP) ..... 2012-044527
Feb. 29, 2012 (JP) ..... 2012-044528

(51) Int. Cl.
*B41M 5/44* (2006.01)
*B41M 5/025* (2006.01)
(Continued)

(52) U.S. Cl.
CPC ..... *B41M 5/44* (2013.01); *B41M 5/0256* (2013.01); *B41M 5/38257* (2013.01); *B41M 5/42* (2013.01); *B41M 5/38214* (2013.01);
(Continued)

(58) Field of Classification Search
CPC ..... B41M 5/0256; B41M 5/42; B41M 5/44; B41M 5/38257; B41M 7/0027
See application file for complete search history.

(56) References Cited

U.S. PATENT DOCUMENTS 5,798,161 A 8/1998 Kita et al.
5,932,319 A 8/1999 Makar et al.
(Continued)

FOREIGN PATENT DOCUMENTS

EP 1316437 6/2003
JP 62-238791 10/1987
(Continued)

OTHER PUBLICATIONS

International Search Report—PCT/JP2013/054996—Jun. 4, 2013.

*Primary Examiner* — Betelhem Shewareged
(74) *Attorney, Agent, or Firm* — Young & Thompson

(57) ABSTRACT

Provided is an intermediate transfer medium. The intermediate transfer medium includes a substrate, a protective layer and a receiving layer. The protective layer includes two or more binder resin varieties and a filler. A mixed binder resin which includes the two or more binder resin types has a storage elastic modulus $G' \geq 1.0 \times 10^5$ Pa and $\leq 1.0 \times 10^9$ Pa at 70° C.-90° C., and the storage elastic modulus G' of more than $1.0 \times 10^9$ Pa at 35° C. The mixed binder resin includes a binder resin having a number average molecular weight (Mn) of not less than 8,000 and not more than 30,000, and a glass transition temperature (Tg) of not less than 36° C. and not more than 60° C.; The filler has a particle diameter of not less than 1 nm and not more than 200 nm.

16 Claims, 1 Drawing Sheet

(51) Int. Cl.

| | |
|---|---|
| ***B41M 5/42*** | (2006.01) |
| ***B41M 5/382*** | (2006.01) |
| *B41M 7/00* | (2006.01) |

(52) U.S. Cl.

CPC ..... *B41M 7/0027* (2013.01); *B41M 2205/02* (2013.01); *B41M 2205/06* (2013.01); *B41M 2205/10* (2013.01); *B41M 2205/40* (2013.01)

(56) References Cited

U.S. PATENT DOCUMENTS

| | | | | |
|---|---|---|---|---|
| 6,797,671 | B2 | 9/2004 | Tamura et al. | |
| 2001/0010851 | A1* | 8/2001 | Kita ..... | B41M 5/0256 428/64.1 |
| 2003/0157356 | A1* | 8/2003 | Tamura ..... | B41M 7/0027 428/542.2 |
| 2007/0031616 | A1 | 2/2007 | Sogabe et al. | |
| 2007/0031617 | A1 | 2/2007 | Field | |

FOREIGN PATENT DOCUMENTS

| | | |
|---|---|---|
| JP | 2000-514377 | 10/2000 |
| JP | 2002-036795 | 2/2002 |
| JP | 2004-351656 | 12/2004 |
| JP | 2005-178098 | 7/2005 |
| JP | 2009-137255 | 6/2009 |
| JP | 2012-051214 | 3/2012 |
| WO | 2006074245 | 7/2006 |

* cited by examiner

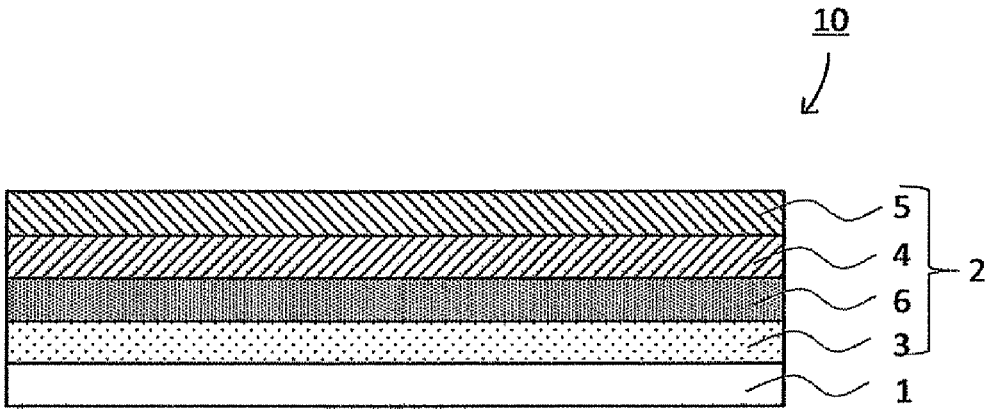
10
5
4
2
6
3
1

INTERMEDIATE TRANSFER MEDIUM

TECHNICAL FIELD

The present invention relates to an intermediate transfer medium. More particularly, the present invention relates to an intermediate transfer medium which excels in foil tearing on transferring a receiving layer to an transcription receiving article, wherein the receiving layer has received a colorant of the thermal transfer sheet, and which can provide a printed article of high durability with ease.

BACKGROUND ART

Conventionally, thermal transfer method has been widely used as a simple printing method. Thermal transfer method is an image forming method wherein a thermal transfer sheet which is provided with a colorant layer formed on a surface of a substrate sheet thereof is superposed on a thermal transfer image-receiving sheet which is optionally provided with an image receiving layer, then the back side of the thermal transfer sheet is heated by a heating means such as a thermal head with a shape of an intended image, and thereby the colorant included in the colorant layer is selectively transferred onto the thermal transfer image-receiving sheet to form the image on the thermal transfer image-receiving sheet.

The thermal transfer method may be divided into two methods, i.e., melt-transfer method and sublimation transfer method. The melt-transfer method is an image forming method wherein a thermal transfer sheet, in which a thermally fusible ink layer comprising a colorant, such as a pigment, and a binder for dissolving or dispersing the colorant, such as a thermally fusible wax or resin, is carried on a substrate sheet such as a PET film, is used; then, an energy in accordance with image information is applied to the thermal transfer sheet by a heating means such as a thermal head; and thereby the colorant is transferred onto the thermal transfer image-receiving sheet, such as a plastic sheet or paper, together with the binder. The image formed by the melt-transfer method is suitable for recording binary images such as characters, since the image has excellent sharpness and high concentration.

On the other hand, the sublimation transfer method is another image forming method wherein a thermal transfer sheet, in which a dye layer comprising a dye which is able to be transferred thermally principally by sublimation, and a resin binder for dissolving or dispersing the dye, is carried on a substrate sheet such as a PET film, is used; then, an energy in accordance with image information is applied to the thermal transfer sheet by a heating means such as a thermal head; and thereby only the dye is transferred onto a substrate sheet, such as a plastic sheet or paper (a thermal transfer image-receiving sheet which is optionally provided with a dye receiving layer). With respect to the sublimation transfer method, since the transferring amount of dye can be controlled by the amount of energy applied, it is possible to form a gray-scale image in which image density of every dot of the thermal head is controlled. In addition, since the colorants used are dyes, the image formed has transparency. Thus, when dyes of different colors are superposed, the reproducibility of neutral tints becomes excellent. Therefore, when using thermal transfer sheets of different colors such as yellow, magenta, cyan, black or the like, and transferring dye of each color on the thermal transfer image-receiving sheet so as to superpose the dyes each other, it is possible to form a photographic full-color image of high quality in which reproducibility of neutral tints is excellent.

Along by the development of various hardware and software related to multimedia, this thermal transferring method have been expanding its market as a full-color hard copy system for digital images represented by computer graphics, satellite static images, CD-ROM or the like, and for analog images such as video. The thermal transfer image-receiving sheet according to the thermal transfer method includes a wide range of concrete applications. As typical examples, proof printing; image output; output of plan or design, such as those drawn by CAD/CAM, etc.; output use for various medical analytical or measuring instruments such as CT scan, endoscopic camera, etc.; and a substitute for instant photos; as well as, output of picture of face to an identification paper or ID card, credit card, or other cards; and applications as composite photograph or souvenir picture at an amusement facilities such as amusement park, amusement arcade, museum, and aquarium, etc., can be mentioned.

With the diversification of use of the above-mentioned thermal transfer image-receiving sheet, there is an increasing demand for forming a thermal transfer image on an arbitrary object. As the object for forming the thermal transfer image, a purpose-built thermal transfer image-receiving sheet which is provided with a receiving layer on the substrate is usually utilized. However, in this case, the substrate or the like subjects to some type of constraints. Under these circumstances, Patent literature 1 discloses an intermediate transfer medium in which the receiving layer is provided on the substrate so that the receiving layer can be peeled off from the substrate. According to the intermediate transfer medium, by transferring the dye of the dye layer to the receiving layer so as to form an image, and then heating the intermediate transfer medium, it is possible to transfer the receiving layer onto which the dye has been transferred to an arbitrary transcription receiving article. Thus, it becomes possible to form a thermal transfer image without concern for the constraints about the kind of transcription receiving article.

On the other hand, the thermal transfer image, which is formed by using the intermediate transfer medium mentioned above, suffers with a problem of lack of durability including weather resistance, abrasion resistance, chemical resistance, etc., since the receiving layer onto which an image is formed is positioned on the outermost surface. Then, recently, as shown in Patent literature 2, an intermediate transfer medium in which a release layer, a protective layer, and a layer functioned both as receiving layer and adhesive layer is provided on a substrate has been proposed. According to the intermediate transfer medium, since the protective layer is formed on the surface of the thermal transfer image, it is possible to impart durability to the thermal transfer image.

PRIOR ART LITERATURE

Patent Literature

Patent literature 1: JP SHO 62-238791 A
Patent literature 2: JP 2004-351656 A

SUMMARY OF THE INVENTION

Problems to be Solved by the Invention

However, the durability of the protective layer of the intermediate transfer medium, which is proposed in Patent literature 2, have not reached the stage to satisfy demands in the fields where a particularly high durability is required, such as the field of identification paper, ID card, credit card, etc.

Therefore, in order to ensure the demands in such fields, it has been adopted a way of putting a PET film, generally described as "PET patch", on the formed image so as to satisfy the demands of durability. However, this way is not preferable in view of the process, because an additional printer is required.

As a function required for the protective layer, the foil tearing is mentioned in conjunction with the above mentioned durability. However, there is a trade-off relationship between the durability and the foil tearing. When improving the durability of the protective layer, the foil tearing of the protective layer has deteriorated. Therefore, it is impossible to satisfy both the durability and the foil tearing in one protective layer up to the present.

The present invention has been made in view of the above-mentioned circumstances, and the present invention aims principally to provide an intermediate transfer medium which excels in the foil tearing on transferring a receiving layer to an transcription receiving article, wherein the receiving layer has received a colorant of the thermal transfer sheet, and which can provide a printed article of high durability with ease.

Means for Solving the Problems

The present invention for solving the above-mentioned problems is an intermediate transfer medium which comprises a substrate, a protective layer and a receiving layer which are layered on a surface of the substrate; wherein the protective layer comprises two or more kinds of binder resins and a filler; wherein a mixed binder resin which consists of the above mentioned two or more kinds of binder resins has a storage elastic modulus G' of not less than $1.0\times10^5$ Pa and not more than $1.0\times10^9$ Pa at 70° C.-90° C., and the storage elastic modulus G' of more than $1.0\times10^9$ Pa at 35° C.; wherein the mixed binder resin includes a binder resin having a number average molecular weight (Mn) of not less than 8,000 and not more than 30,000, and a glass transition temperature (Tg) of not less than 36° C. and not more than 60° C.; and wherein the filler has a particle diameter of not less than 1 nm and not more than 200 nm.

Further, the filler may be included in an amount of not less than 1% by weight and not more than 35% by weight on a base of total solid content of the protective layer. In addition, the binder resin having the number average molecular weight (Mn) of not less than 8,000 and not more than 30,000, and the glass transition temperature (Tg) of not less than 36° C. and not more than 60° C. may be included in an amount of not less than 10% by weight on a base of total solid content of the mixed binder resin.

Alternatively, the present invention for solving the above-mentioned problems is an intermediate transfer medium which comprises a substrate, a protective layer and a receiving layer which are layered on a surface of the substrate; wherein the protective layer comprises a binder resin having a number average molecular weight (Mn) of not less than 8,000 and not more than 30,000, and a glass transition temperature (Tg) of not less than 36° C. and not more than 60° C.

Further, the binder resin may be included in an amount of not less than 20% by weight and not more than 100% by weight on a base of total solid content of the protective layer. In addition, the binder resin may be polyester or polyester urethane.

Still another, the present invention for solving the above-mentioned problems is an intermediate transfer medium which comprises a substrate, a protective layer and a receiving layer which are layered on a surface of the substrate; wherein the protective layer comprises a binder resin which is regulated so as to have a storage elastic modulus G' of not less than $1.0\times10^5$ Pa and not more than $1.0\times10^9$ Pa at 70° C.-90° C., and the storage elastic modulus G' of more than $1.0\times10^9$ Pa at 35° C.

Further, the binder resin may be a mixed resin which consists of 2 or more kinds of resins to be mixed mutually. In addition, the binder resin may be polyester resin or polyester urethane resin.

Still more, the present invention for solving the above-mentioned problems is an intermediate transfer medium which comprises a substrate, a protective layer and a receiving layer which are layered on a surface of the substrate; wherein the protective layer comprises a binder resin and a filler which has a particle diameter of not less than 1 nm and not more than 200 nm.

Further, the filler may be included in an amount of not less than 5% by weight and not more than 40% by weight on a base of total solid content of the protective layer. In addition, the filler may be organic filler.

Effects of the Invention

According to the present invention, it is possible to provide an intermediate transfer medium which excels in the foil tearing on transferring a receiving layer to an transcription receiving article, wherein the receiving layer has received a colorant of the thermal transfer sheet, and which can provide a printed article of high durability with ease.

BRIEF DESCRIPTION OF THE DRAWINGS

FIG. 1 is a schematic sectional view which illustrates a layered construction of the intermediate transfer medium according to the present invention.

MODE FOR CARRYING OUT THE INVENTION

Now, the intermediate transfer medium 10 according to the present invention will be described below in detail with reference to the drawings. As shown in FIG. 1, the intermediate transfer medium 10 according to the present invention comprises a substrate 1, and a protective layer 4 and a receiving layer 5 which are formed on one surface side of the substrate 1 (the upper side surface of the substrate 1 in the case shown in FIG. 1). The protective layer 4 and the receiving layer 5 are the layers which are transferred to a transcription receiving article at the time of thermal transfer. Hereinafter, the layers which are transferred to a transcription receiving article at the time of thermal transfer may be collectively called a transfer layer 2 in places. Incidentally, in the embodiment shown in FIG. 1, the transfer layer consists of an exfoliate layer 3, a plasticizer-resistive layer 6, the protective layer 4 and the receiving layer 5. The exfoliate layer 3, and the plasticizer-resistive layer 6 are optional constituents in the intermediate transfer medium 10 according to the present invention. Respective constituents of the present invention will be described more concretely below.

(Substrate)

The substrate 1 is essential constituent of the intermediate transfer medium 10 of the present invention, and is provided to hold the transfer layer 2. There is no particular limitation on the substrate 1, and as the substrate, unstretched or stretched plastic films, for instance, polyesters having high heat resistance such as polyethylene terephthalate and polyethylene naphthalate; polypropylene; polycarbonate; cellulose acetate; polyethylene derivatives; polyamides, and polymethylpentene, etc., can be exemplified. Composite films obtained by laminating two or more of these materials can be also used.

The thickness of the substrate 1 may be appropriately selected depending on the kind of the material used, so that the strength, heat resistance and the like of the substrate lie in appropriate ranges. Usually, about 1-100 μm in thickness is preferably used.

(Transfer Layer)

As shown in FIG. 1, on the substrate 1, the transfer layer 2 is formed so that it is able to be separated from the substrate 1 at the time of heat transfer. This transfer layer 2 comprises at least the protective layer 4 and the receiving layer 5, both of which are essential constituents of the intermediate transfer medium 10 of the present invention. The transfer layer 2 is exfoliated from the substrate 1 and is transferred to a transcription receiving article during the thermal transfer.

(Protective Layer)

Now, the protective layer 4 in the intermediate transfer medium 10 of the present invention will be explained concretely by referring to a first embodiment to a fourth embodiment.

Protective Layer of the First Embodiment

It is considered that the foil tearing of the protective layer 4 is greatly influenced by the glass transition temperature (Tg) of the binder resin which is included in the protective layer 4. Regardless of the degree of the number average molecular weight (Mn), when a binder resin having a glass transition temperature (Tg) of more than 60° C. is only used as the resin which constitutes the protective layer, the foil tearing of the protective layer is degraded. On the other hand, when a binder resin having a glass transition temperature (Tg) of less than 36° C. is used, the foil tearing of the protective layer is improved. However, when the binder resin having the glass transition temperature (Tg) of less than 36° C. is only used as the resin which constitutes the protective layer, the protective layer softens even at a constant temperature and cause sticky feel, and thus the durability and the preservability of the protective layer 4 are degraded.

On the other hand, it is considered that the durability of the protective layer 4 is greatly influenced by the degree of the number average molecular weight (Mn) of the binder resin which is included in the protective layer 4. Regardless of the degree of the glass transition temperature (Tg), when a binder resin having the number average molecular weight (Mn) of less than 8,000 is only used as the resin which constitutes the protective layer, the durability of the protective layer cannot reach a satisfied level. On the other hand, when a binder resin having the number average molecular weight (Mn) of more than 30,000 is only used as the resin which constitutes the protective layer, the foil tearing of the transfer layer is degraded, regardless of whether the glass transition temperature (Tg) of the binder resin is in the range of not less than 36° C. and not more than 60° C. or not.

Thus, the protective layer 4 of the first embodiment includes a binder resin having a number average molecular weight (Mn) of not less than 8,000 and not more than 30,000, and a glass transition temperature (Tg) of not less than 36° C. and not more than 60° C. By containing the binder resin, the number average molecular weight (Mn) and the glass transition temperature (Tg) of which fulfill the above mentioned ranges, in the protective layer 4, it is possible to satisfy both the foil tearing and the durability. Hereinafter, the binder resin having a number average molecular weight (Mn) of not less than 8,000 and not more than 30,000, and a glass transition temperature (Tg) of not less than 36° C. and not more than 60° C. is referred to as the "specific binder resin" in places. Incidentally, the number average molecular weight (Mn) used herein denotes a number average molecular weight measured by GPC in terms of polystyrene standard. The glass transition temperature (Tg) used herein denotes a temperature calculated from measurement of a change of calorie (DSC method) in accordance with the DSC (differential scanning calorimetry).

When both the number average molecular weight (Mn) and the glass transition temperature (Tg) fulfill the above mentioned conditions, it is possible to satisfy both the foil tearing and the durability, as mentioned above. In addition, for the purpose of seeking a further high durability, it is preferable to use a binder resin having a number average molecular weight (Mn) of not less than 12,000.

The important point of the present invention is to contain the binder resin, both the number average molecular weight (Mn) and the glass transition temperature (Tg) of which fulfill the above mentioned conditions, into the protective layer 4. Thus, if a binder resin, the number average molecular weight (Mn) of which is out from the above mentioned range and the glass transition temperature (Tg) of which is in the range of not less than 36° C. and not more than 60° C., and another binder resin, the number average molecular weight (Mn) of which is in the range of not less than 8,000 and not more than 30,000 and the glass transition temperature (Tg) of which is out from the above mentioned range, are included in the protective layer, it is impossible to satisfy both the foil tearing and the durability.

There is no particular limitation for the containing amount of the "specific binder resin". When the containing amount of the "specific binder resin" is less than 20% by weight on a base of the total solid content of the protective layer 4, however, there may be a tendency for the foil tearing and the durability to decrease. Thus, in view of this point, it is preferable that the "specific binder resin" is contained in an amount of not less than 20% by weight, more particularly, an amount of not less than 30% by weight, on a base of the total solid content of the protective layer 4. The upper limit of the containing amount of the "specific binder resin" is not particularly limited, and the upper limit is 100% by weight on a base of the total solid content of the protective layer 4.

As for the "specific binder resin", there is no particular limitation, and it is possible to select arbitrarily any resin component which satisfy the conditions, that is, the number average molecular weight (Mn) being of not less than 8,000 and not more than 30,000, and a glass transition temperature (Tg) being of not less than 36° C. and not more than 60° C. For instance, polyester resins, polyester urethane resins, polycarbonate resins, acrylic resins, ultraviolet ray absorbing resins, epoxy resins, acryl urethane resins, silicone modified resins of the above mentioned resins, mixtures of any combination of the above mentioned resins, ionizing radiation-curable resins, ultraviolet ray absorbing resins, etc., may be enumerated, as long as the number average molecular weight (Mn) and the glass transition temperature (Tg) of which resins satisfy the above mentioned conditions.

Among them, in the present invention, the polyester resins and the polyester urethane resins, the number average molecular weight (Mn) and the glass transition temperature (Tg) of which resins satisfy the above mentioned conditions, are used suitably. Herein, the polyester resins and the polyester urethane resins may be copolymer type resins which are copolymerized with other thermoplastic resin. Commercially available polyester resins and polyester urethane resins, the number average molecular weight (Mn) and the glass transition temperature (Tg) of which resins satisfy the above mentioned conditions, may be used as-is in the present invention.

For instance, VYLON 600 (polyester, manufactured by TOYOBO Co., Ltd., number average molecular weight (Mn): 16000, glass transition temperature (Tg): 47° C.), VYLON GK-110 (polyester, manufactured by TOYOBO Co., Ltd., number average molecular weight (Mn): 16000, glass transition temperature (Tg): 52° C.), VYLON GK-780 (polyester, manufactured by TOYOBO Co., Ltd., number average molecular weight (Mn): 11000, glass transition temperature (Tg): 36° C.), and UR-1350 (polyester urethane, manufactured by UNITIKA, Ltd., number average molecular weight (Mn): 30000, glass transition temperature (Tg): 42° C.), etc., may be enumerated.

In addition, the ionizing radiation-curable resins, the number average molecular weight (Mn) and the glass transition temperature (Tg) of which satisfy the above mentioned conditions, are suitable as the "specific binder resin" in view of their superior plasticizer resistance and superior abrasion resistance. There is no particular limitation with respect to the ionizing radiation-curable resin, and thus it can be suitably selected from among the ionizing radiation-curable resins known in the art, and, for instance, it is possible to use the one in which a radically polymerizable polymer or oligomer is cross-linked and cured by irradiation of ionizing radiation, and optionally polymerized and cross-linked by electron beam or ultraviolet light with using a photo-polymerization initiator additively. In addition, the ultraviolet ray absorbing resins, the number average molecular weight (Mn) and the glass transition temperature (Tg) of which satisfy the above mentioned conditions, are suitable as the "specific binder resin" in view of giving light resistance to the printed matter.

As the ultraviolet ray absorbing resin, for instance, a resin which is prepared by reacting and linking a reactive ultraviolet ray absorbing agent to a thermoplastic resin or an ionizing radiation-curable resin mentioned above can be used. More concretely, those which prepared by introducing a reactive group such as an addition-polymerizable double bond (for instance, vinyl group, acryloyl group, methacryloyl group, etc.), alcoholic hydroxyl group, amino group, carboxyl group, epoxy group, isocyanate group, etc., into a non-reactive organic ultraviolet absorbing agent known in the art such as salicylate series, benzophenon series, benzotriazole series, substituted acrylonitrile series, nikkel-chelate series, hindered amine series, etc., can be exemplified.

Further, the protective layer 4 may contain any other binder resin in addition to the "specific binder resin". For instance, in the case that the protective layer 4 contains a binder resin, the number average molecular weight (Mn) of which is more than 3000, in addition to the "specific binder resin", by regulating the containing amount of the "specific binder resin" so as to fall into the above mentioned preferable range, it is possible to improve further the durability while the improving effect for the foil tearing is maintained. As this case, it is possible to contain any other binder resin in addition to the "specific binder resin", in accordance with various functions demanded for the protective layer 4.

If necessary, it is also possible to add any additive, for example, various fillers, fluorescent whitener, UV absorbers for improving the durability, etc., in addition to the "specific binder resin". For instance, when the filler mentioned below in the third embodiment or the like is added, it is possible to improve further the foil tearing. With respect to a preferable containing amount of the filler, it is the same with the range described in the third embodiment. Similar respect also applies to the protective layer of the second embodiment in the containing amount.

In the present invention, since the foil tearing of the protective layer 4 is excellent, it is possible to thicken the thickness of the protective layer as compared with the thickness of the conventional protective layers. Thus, in addition to the durability due to the usage of the "specific binder resin", an improvement in the durability due to the enhancement of the thickness can be also expected. Even when the thickness of the protective layer sets to be thinner, the durability which is sought for the protective layer can be fulfilled with the durability offered by the "specific binder resin". There is no particular limitation about the thickness of the protective layer 4. However, when the thickness of the protective layer 4 exceeds 30 μm, there is a tendency for the foil tearing to lower, and when the thickness of the protective layer 4 is less than 2 μm, there is a tendency for the durability to lower. Thus, considering such aspects, it is preferable that the thickness of the protective layer 4 is in the range of not less than 2 μm and not more than 30 μm. Similar respect also applies to the protective layers of the second embodiment to the fourth embodiment in the thickness of the protective layer.

As the method for forming the protective layer 4 of the first embodiment, such a procedure in which the "specific binder resin", and optionally added other binder resin and/or various material is dissolved or dispersed in an appropriate solvent in order to prepare a coating liquid for protective layer, and the coating liquid thus prepared is coated on the substrate 1, (or on the exfoliate layer 3 which is optionally provided on the substrate 1), in accordance with a known procedure such as gravure printing method, screen printing method, or reverse-coating method using a gravure plate, etc., and then the coated film is dried, may be applicable.

Protective Layer of the Second Embodiment

As described in the explanation about the protective layer 4 of the first embodiment, it is considered that the foil tearing of the protective layer 4 is affected closely by the glass transition temperature (Tg) of the binder resin which is included in the protective layer 4, and the durability of the protective layer 4 is affected closely by the thickness of the protective layer and the molecular weight of the binder resin which is included in the protective layer 4. However, when a binder resin, the glass transition temperature (Tg) of which is in the prescribed range, and another binder resin, the molecular weight of which is in the prescribed range, are merely included in the protective layer, it is impossible to satisfy both the foil tearing and the durability up to the present.

Under such a situation, we, the inventors, have focused the temperature at which the transfer layer 2 which includes the protective layer 4 is peeled off from the substrate 1, and have found that the transfer layer 2 which includes the protective layer 4 is peeled off from the substrate 1 in the temperature range of 70° C.-90° C. Further, we, the inventors, have studied various physical properties of the binder resin in this temperature range. As a consequence, we have found that a protective layer 4 which excels in the durability and the foil tearing can be obtained by containing a binder resin which is regulated so as to have a storage elastic modulus G' of not less than $1.0\times10^5$ Pa and not more than $1.0\times10^9$ Pa at 70° C.-90° C. into the protective layer 4. Further, we have found that the durability and the preservability of the protective layer 4 are improved, without causing sticky feel on the surface of a printed matter to which the transfer layer 2 has been transferred, when the binder resin further satisfies the condition that the storage elastic modulus G' is more than $1.0\times10^9$ Pa at 35° C. When the storage elastic modulus G' at 35° C. falls into the above mentioned range, it is possible to satisfy the durability and the preservability of the protective layer 4 sufficiently, even if the ambient temperature during the preservation of the printed matter to which the transfer layer 2 has been transferred rises up to about 35° C. from about the constant room temperature.

Thus, the protective layer 4 of the second embodiment includes a binder resin which is regulated so as to have a storage elastic modulus G' of not less than $1.0\times10^5$ Pa and not more than $1.0\times10^9$ Pa at 70° C.-90° C., and the storage elastic modulus G' of more than $1.0\times10^9$ Pa at 35° C. According to the intermediate transfer medium which is provided with the protective layer 4 having the above mentioned characteristics, it is possible to provide an intermediate transfer medium which excels in the foil tearing on transferring a receiving layer to an transcription receiving article, wherein the receiving layer has received a colorant of the thermal transfer sheet, and to provide a printed article of high durability with ease, regardless of the ingredient of the binder resin or the various physical properties other than the storage elastic modulus G'.

Although the storage elastic modulus G' at 70° C.-90° C. being in the above mentioned range is adequate for the second embodiment, it is more preferable that the storage elastic modulus G' at this temperature range is in the range of not less than $1.0\times10^5$ Pa and not more than $1.0\times10^8$ Pa. Further, it is preferable that the storage elastic modulus G' at 120° C. is in the range of not more than $1.0\times10^9$ Pa.

As the binder resin contained in the protective layer 4, it is possible to use any resin as long as the storage elastic modulus G' thereof is regulated so as to be within the above mentioned range. There is no particular limitation for the method of regulating the storage elastic modulus G', for example, the storage elastic modulus G' can be regulated by mixing two or more kinds of resin so as to satisfy the above mentioned range. Alternatively, the storage elastic modulus G' can be regulated by adding one of more of various additives into one or more kinds of resins so as to satisfy the above mentioned range. If the storage elastic modulus G' of a certain resin is within the above mentioned range, it is possible to use the resin singly as it is.

That is, in the present invention, when saying that the binder resin which storage elastic modulus G' is regulated so as to fall within the above mentioned range, it includes not only single resins each of which storage elastic modulus G' is within the above mentioned range, but also includes mixed resins each of which storage elastic modulus G' is regulated to be within the above mentioned range by means of mixing two or more of different resins; copolymers of various resins; and resins each of which storage elastic modulus G' is regulated by adding one of more of various additives into one or more kinds of resins so as to satisfy the above mentioned range.

As the resin for regulating the storage elastic modulus G' within the above mentioned range, for example, polyester resins, polycarbonate resins, acrylic resins, ultraviolet absorbing resins, epoxy resins, polystyrene resins, polyester urethane resins, acrylic urethane resins, silicone modified resins of the above mentioned resins, mixture of any combination of the above mentioned resins, ionizing radiation-curable resins, ultraviolet ray absorbing resins, etc., may be enumerated. Among them, in the present invention, it is preferable to use a polyester resin or polyester urethane resin which storage elastic modulus G' is within the above mentioned range, or a copolymer of one of these resins and another thermoplastic resin, or to include, as the resin for regulating the storage elastic modulus G' within the above mentioned range, polyester resin, polyester urethane resin, or a copolymer of one of these resins and another thermoplastic resin. The polyester resin, the polyester urethane resin, and the copolymer of one of these resins and another thermoplastic resin are easy in regulating the storage elastic modulus G', and are expected to improve further the foil tearing and the durability.

In addition, the ionizing radiation-curable resins are suitable as the binder resin for regulating the storage elastic modulus G' within the above mentioned range in view of their superior plasticizer resistance and superior abrasion resistance. Further, the ultraviolet ray absorbing resins are suitable as the binder resin for regulating the storage elastic modulus G' within the above mentioned range in view of giving light resistance to the printed matter. With respect to the ionizing radiation-curable resins and the ultraviolet ray absorbing resins, those which has been described above in the first embodiment can be used as they are, thus detailed description thereof is omitted here.

The storage elastic modulus G' of the binder resin is a value that is measured by a dynamic viscoelasticity measuring instrument in accordance with JIS K7244-6. As the dynamic viscoelasticity measuring instrument, it is possible to use the ARES dynamic viscoelasticity measurement instrument, manufactured by TA Instrument, Japan (Advanced Rheometric Expansion System), and so on.

The storage elastic modulus G' of a binder resin in which two or more kinds of resin are mixed is a value that is determined by measuring values of the storage elastic modulus G' of individual resins to be mixed, and calculating from the values in consideration of their mixing ratio. Next, assuming that the binder resin in which two or more kinds of resins are mixed is composed of three kinds of resins, i.e., a resin A (a %), a resin B (b %), and a resin C (c %), wherein a %+b %+c %=100%, the storage elastic modulus G' of the mixed type binder resin in which two or more kinds of resins are mixed will be explained. Upon the calculation of the storage elastic modulus G' of the mixed type binder resin, the following equation is used. In this equation, G'(A) represents the storage elastic modulus G' of the resin A, G' (B) represents the storage elastic modulus G' of the resin B, and G'(C) represents the storage elastic modulus G' of the resin C, respectively. Further, G' represents the storage elastic modulus G' of the mixed type binder resin.

$$G'=10^{(\log(G'(A))\times a/100+(\log(G'(B))\times b/100+(\log(G'(C))\times c/100)} \quad \text{[Math. 1]}$$

wherein, $(\log(G'(A))\times a/100+(\log(G'(B))\times b/100+(\log(G'(C))\times c/100)$ represent an index.

Further, the protective layer 4 may contain any other binder resin which storage elastic modulus G' is out of the above mentioned range, in addition to the binder resin which storage elastic modulus G' is regulated to be within the above mentioned range. In this case, it is necessary that the storage elastic modulus G' which is calculated by the above mentioned equation is within the range of the present invention. More concretely, the storage elastic modulus G' of the whole of the resins which include the binder resin which storage elastic modulus G' and the binder resin which storage elastic modulus G' is out of the above mentioned range should be within the range of the present invention.

If necessary, it is also possible to add any additive, for example, various fillers, fluorescent whitener, UV absorbers for improving the durability, etc., in addition to the binder resin which storage elastic modulus G' is regulated so as to fall within the above mentioned range.

As the method for forming the protective layer 4 of the second embodiment, such a procedure in which the binder resin which storage elastic modulus G' is regulated so as to fall within the above mentioned range, and optionally added other binder resin and/or various material is dissolved or dispersed in an appropriate solvent in order to prepare a coating liquid for protective layer, and the coating liquid thus prepared is coated on the substrate 1, (or on the exfoliate layer 3 which is optionally provided on the substrate 1), in accordance with a known procedure such as gravure printing method, screen printing method, or reverse-coating method using a gravure plate, etc., and then the coated film is dried, may be applicable.

Protective Layer of the Third Embodiment

The protective layer 4 of the third embodiment comprises a binder resin and a filler which has a particle diameter of not less than 1 nm and not more than 200 nm. According to the intermediate transfer medium 10 of the present invention which is provided with a protective layer 4 which contains the filler having a particle diameter of not less than 1 nm and not more than 200 nm, it is possible to improve the foil tearing on transferring this protective layer, and the durability of the image to which the protective layer is transferred, without deteriorating the glossiness of the protective layer 4. Although the precise mechanism about why the above mentioned excellent effects are brought by adding the filler having a particle diameter within the above mentioned range into the protective layer 4 has been not fully elucidated, but it is expected that the shearing of the protective layer 4 may be improved by addition of the filler having a particle diameter within the above mentioned range into the protective layer 4, and the improvement in the shearing would contribute to the improvement in the foil tearing. Further, since the particle diameter of the filler to be contained in the protective layer 4 is very small as it is not less than 1 nm and not more than 200 nm, it is expected that the filler would be less likely to cause deterioration in the glossiness of the protective layer 4, and also be less likely to cause a decrease in durability. Here, the aspect that the particle diameter of the filler has close relationships with the glossiness, the foil tearing, and the durability, of the protective layer 4, is obvious from the results of Examples and Comparative examples described below.

(Filler)

The particle diameter of the filler used herein means volume average particle diameter. For example, the particle diameter of the filler can be measured by the BET method, or analyzing results of the electron microscopic observation image with an image analysis type particle size distribution measuring software.

As the filler to be contained in the protective layer 4, as long as it satisfies the condition that the particle diameter thereof is not less than 1 nm and not more than 200 nm, any of organic fillers, inorganic fillers, and organic-inorganic hybrid type fillers can be used preferably. These fillers may be in powder form or in a sol form. As the powdery organic filler, for instance, acrylic particles, such as non-cross linked acrylic particles and cross linked acrylic particles; polyamide type particles; fluorine-contained resin type particles; polyethylene waxes, etc., can be enumerated. As the powdery inorganic filler, for instance, calcium carbonate particles, and metal oxide particles such as silica particles and titanium oxide, etc., can be enumerated. As the organic-inorganic hybrid type filler, for instance, the filler in which silica particles are hybridized with acrylic resin, etc., can be enumerated. As the sol type filler, for instance, silica sol type, organosol type, etc., can be enumerated. These fillers may be used solely on an individual basis, or may be used as a mixture of two or more of them in combination. Further, as long as the particle diameters of the fillers interested are within the above mentioned range, it is possible to contain fillers having different particle diameters Incidentally, although the present invention is characterized in that the filler having a particle diameter within the above mentioned range is contained in the protective layer 4, but the present invention does not exclude any embodiment in which the filler having a particle diameter out of the above mentioned range is contained in part into the protective layer 4. As long as it does not deviate from the scope and spirit of the present invention, it is possible that the filler having a particle diameter out of the above mentioned range is contained in part.

As described above, as long as the filler to be contained in the protective layer 4 satisfies the above mentioned condition for the range of particle diameter, it is possible to improve the foil tearing property and the durability. If it is intended to further improve the durability, however, the use of organic filler is preferred. As the organic filler, the acrylic particles are particularly preferred. This is considered to be relevant to good compatibility of the organic filler. Concretely, the organic filler has an excellent compatibility than inorganic filler. Therefore, it is considered that a protective layer 4 which is formed by using an organic filler can enjoy a higher improvement effect on the adhesiveness of the protective layer 4, as compared with the case of another protective layer 4 which is formed by using an inorganic filler. Further, it is expected that this improvement on the adhesiveness contributes to a further improvement on the durability.

As the filler, it is possible to use a powdery form one, or use a sol form one. However, since the powdery form filler has a wide choice of options for the solvent to be used for preparing a coating solution for forming the protective layer 4, and also excels in coating compatibility, the powdery form filler is desirable.

There is no particular limitation about the filler content. However, when the filler content is less than 10% by weight on a basis of the total solid content of the protective layer 4, it may not be able to satisfy fully the foil tearing property. On the other hand, when it exceeds 40% by weight, there is a tendency that durability and transparency of the protective layer 4 is reduced. Therefore, considering this point, it is desirable that the filler is contained in the range of not less than 10% by weight and not more than 40% by weight on a basis of the total solid content of the protective layer 4.

(Binder Resin)

There is no particular limitation on the binder resin contained in the protective layer 4. As the binder resin, for example, polyester resins, polycarbonate resins, acrylic resins, ultraviolet absorbing resins, epoxy resins, polystyrene resins, polyurethane resins, acrylic urethane resins, silicone modified forms of these thermoplastic resins, mixtures of any combination of the above mentioned resins, ionizing radiation-curable resins, ultraviolet ray absorbing resins, etc., may be usable.

As the binder resin, those which have a number average molecular weight (Mn) in the range of about 8,000-about 30,000 are preferable. Incidentally, the number average molecular weight (Mn) used herein denotes a number average molecular weight measured by GPC in terms of polystyrene standard. When the binder resin having a number average molecular weight (Mn) of less than 8000 is used, there is a tendency that the durability is lowered, and when the binder resin having a number average molecular weight (Mn) of more than 30000 is used, there is a tendency that the foil tearing is degraded. In the present invention, by containing the filler the particle diameter of which fulfills the above mentioned range, it is possible to improve the durability and the foil tearing property. Thus, even when, as the binder resin, the one which has an average molecular weight (Mn) being out of the above preferred range is used, it is possible to provide a protective layer 4, the durability and the foil tearing property of which are amply improved as compared with the conventional protective layer. As preferred binder resins, for example, polyester resins having a number average molecular weight (Mn) of about 10,000 to about 20,000, etc., may be enumerated.

In addition, the ionizing radiation-curable resins can be used suitably as the binder resin of the protective layer 4 in view of their superior plasticizer resistance and superior abrasion resistance. Further, the ultraviolet ray absorbing resins are suitable as the binder resin of the protective layer in view of giving light resistance to the printed matter. With respect to the ionizing radiation-curable resins and the ultraviolet ray absorbing resins, those which has been described above in the first embodiment can be used as they are, thus detailed description thereof is omitted here.

As the method for forming the protective layer 4 of the third embodiment, such a procedure in which one or more kinds of the above mentioned binder resins, and a filler is dissolved or dispersed in an appropriate solvent in order to prepare a coating liquid for protective layer, and the coating liquid thus prepared is coated on the substrate 1 (or on the exfoliate layer 3 which is optionally provided on the substrate 1), in accordance with a known procedure such as gravure printing method, screen printing method, or reverse-coating method using a gravure plate, etc., and then the coated film is dried, may be applicable.

Protective Layer of the Fourth Embodiment

The protective layer 4 of the fourth embodiment is the one which includes features of the protective layers according to the first embodiment to the third embodiment. According to the protective layer 4 of the fourth embodiment, it is possible to give extremely excellent foil tearing and durability to the protective layer, by a synergistic effect of the features in the first embodiment to the third embodiment. Further, the protective layer 4 of the fourth embodiment also excels in the glossiness and the plasticizer resistance.

In the protective layer 4 of the fourth embodiment, two or more kinds of binder resins, and a filler are contained as essential components.

The protective layer 4 of the fourth embodiment is characterized in that it contains two or more kinds of binder resins, which includes the binder resin having a number average molecular weight (Mn) of not less than 8,000 and not more than 30,000, and a glass transition temperature (Tg) of not less than 36° C. and not more than 60° C., that is, the "specific binder resin" as described in the above mentioned first embodiment; and in that the binder resin which is prepared by mixing the aforementioned, two or more kinds of binder resins (Hereinafter, the mixed binder resin which is prepared by mixing two or more kinds of binder resins is referred to as "mixed type binder resin" in places) has the storage elastic modulus G' which satisfies the following conditions 1 and 2. According to the intermediate transfer medium which is provided with the protective layer of this embodiment which satisfies these features, it is possible to attain further improvements in the foil tearing and durability by a synergistic effect of the "specific binder resin" and the "mixed type binder resin" the storage elastic modulus G' of which satisfies the following conditions 1 and 2, even if compared with the protective layer which contains the "specific binder resin" merely.

As the "specific binder resin" of the fourth embodiment, the "specific binder resin" which has described above in the first embodiment, that is, the binder resin having a number average molecular weight (Mn) of not less than 8,000 and not more than 30,000, and a glass transition temperature (Tg) of not less than 36° C. and not more than 60° C., can be used as-is. Thus, the explanation thereof is omitted here. [0068]

Condition 1: Storage elastic modulus G' at 70° C.-90° C. of the "mixed type binder resin" falls in the range of not less than $1.0\times10^5$ Pa and not more than $1.0\times10^9$ Pa.

Condition 2: Storage elastic modulus G' at 35° C. of the "mixed type binder resin" is more than $1.0\times10^9$ Pa.

The condition 1 is the storage elastic modulus G' which is focused the temperature at which the transfer layer 2 which includes the protective layer 4 is peeled off from the substrate 1, and when the storage elastic modulus G' at 70° C.-90° C. of the "mixed type binder resin" falls in the range of not less than $1.0\times10^5$ Pa and not more than $1.0\times10^9$ Pa, it is possible to give further improvement in the foil tearing and the durability.

The condition 2 is the storage elastic modulus G' which is focused to the durability and the and preservability, and when the storage elastic modulus G' at 35° C. of the "mixed type binder resin" is more than $1.0\times10^9$ Pa, the durability and the preservability of the protective layer 4 are improved, without causing sticky feel on the surface of a printed matter to which the transfer layer 2 has been transferred. Further, when the "mixed type binder resin" which satisfies the condition 2 is used, it is possible to satisfy the durability and the preservability of the protective layer 4 sufficiently, even if the ambient temperature during the preservation of the printed matter to which the transfer layer 2 has been transferred rises up to about 35° C. from about the constant room temperature.

In the present invention, the "mixed type binder resin", which is prepared by mixing two or more kind of binder resins with including the "specific binder resin", is designed so that the storage elastic modulus G' of the "mixed type binder resin" satisfies the above mentioned conditions 1 and 2. This is due to the fact that it is difficult for the "specific binder resin" alone to satisfy the above mentioned conditions 1 and 2 for the storage elastic modulus G'. Namely, the binder resin(s) which is other than the "specific binder resin" and is included in the protective layer 4 plays a role to adjust the storage elastic modulus G' so as to satisfy the above conditions 1 and 2.

Further, when, as the binder resin which serves to adjust the storage elastic modulus G' so as to satisfy the above conditions 1 and 2, the one which has a relatively high glass transition temperature (Tg), concretely, has a glass transition temperature (Tg) of not less than 65° C. is used, it is possible to further improve the preservability and durability. On the other hand, when the one which has a relatively low glass transition temperature (Tg), concretely, has a glass transition temperature (Tg) of not less than 10° C. and not more than 35° C. is used, it is possible to further improve the transferability of the protective layer, while maintaining the preservability. Therefore, upon regulating the storage elastic modulus G' of the "mixed type binder resin" with a binder other than the "specific binder resin", it is preferable to select and set appropriately the binder resin other than the "specific binder resin" in consideration of these points.

As the binder resin which is used for regulating the storage elastic modulus G' so as to satisfy the conditions 1 and 2, the resins for regulating the storage elastic modulus G' of the protective layer 4 of the above mentioned second embodiment can be used as-is, and thus, the explanation thereof is omitted here.

Herein, as long as the storage elastic modulus G' of the "mixed type binder resin" can satisfy the above mentioned conditions 1 and 2 ultimately, there is no particular limitation for the value of the storage elastic modulus G' of each individual binder resin contained in the protective layer 4, and it is not necessary to satisfy the above mentioned conditions 1 and 2. Further, it is possible that all of the binder resins included in the "mixed type binder resin" are of the "specific binder resins". That is, without using a binder resin other than the "specific binder resin", and with using two or more of the "specific binder resins", it is possible to regulate the storage elastic modulus G' so as to satisfy the above mentioned conditions 1 and 2. Alternatively, it is possible to use one or more of binder resin(s) other than the "specific binder resin", in combination with two or more of the "specific binder resins". it is also possible to use two or more of binder resins other than the "specific binder resin", in combination with a single "specific binder resin".

The storage elastic modulus G' of the "mixed type binder resin" used herein is a value that is measured by a dynamic viscoelasticity measuring instrument in accordance with JIS K7244-6. Namely, the procedure described for the protective layer 4 of the above mentioned second embodiment can be used as-is, and thus, the explanation thereof is omitted here.

The storage elastic modulus G' of the "mixed type binder resin" used herein can be determined by using the equation which has been described in the explanation about the "storage elastic modulus G' of the mixed type binder resin in which two or more kinds of resin are mixed" in the protective layer 4 of the above mentioned second embodiment.

There is no particular limitation for the content of the "mixed type binder resin". In the case that the content of the "mixed type binder resin" is less than 65% by weight on a base of the total solid content of the protective layer, however, there is a tendency that the foil tearing and the durability may become lower. On the other hand, in the case that the content of the "mixed type binder resin" is more than 99% by weight on a base of the total solid content of the protective layer, since the content of the filler described later becomes lower, there is a tendency that the effect of improving the foil tearing due to the inclusion of the filler is reduced. Therefore, considering these points, it is desirable that the "mixed type binder resin" is contained in the range of not less than 65% by weight and not more than 99% by weight on a base of the total solid content of the protective layer.

There is no particular limitation for the content of the "specific binder resin" to the total solid content of the "mixed type binder resin". The more the content of the "specific binder resin" in the "mixed type binder resin" increases, the more the foil tearing and the durability can be improved, as compared with the case of the "mixed type binder resin" which contains no "specific binder resin". Here, in the case that the content of the "specific binder resin" to the total solid content of the "mixed type binder resin" is less than 10% by weight, there is a tendency that the effect of improving the foil tearing and durability due to the inclusion of the "specific binder resin" is reduced. Therefore, it is desirable that the content of the "specific binder resin" is in the range of not less than 10% by weight on the base of the total solid content of the "mixed type binder resin". There is no particular limitation on the upper limit of the content of the "specific binder resin", and it may be contained within a range that allows the storage elastic modulus G' satisfies the conditions 1 and 2. For example, as described above, when the storage elastic modulus G' is regulated with using two or more of the "specific binder resin", but without using a binder resin other than the "specific binder resin", the content of the "specific binder resins" to the total solid content of the "mixed type binder resin" becomes 100% by weight. In other words, the upper limit is 100% by weight. Further, in the case that the binder resin(s) other than the "specific binder resin" is contained in the "mixed type binder resin", in other words, in the case that the storage elastic modulus G' is regulated with using binder resin(s) other than the "specific binder resin", in addition to the "specific binder resin(s)", an example of the upper limit of the content of the "specific binder resins" to the total solid content of the "mixed type binder resin" may be about 80% by weight.

<Filler>

As mentioned above, the fourth embodiment has been discussed with a particular emphasis on the point that the improvement on the foil tearing and the durability of the protective layer can be attained by containing the "mixed type binder resin", the storage elastic modulus G' of which satisfies the above mentioned conditions 1 and 2, and which contain the "specific binder resin", in the protective layer. However, in the protective layer 4 of the fourth embodiment, not only the above mentioned point, but also another approach from the aspect of the filler, a further improvement on the foil tearing is conceived. Concretely, in this fourth embodiment, a filler having a particle diameter of not less than 1 nm and not more than 200 nm is contained in the protective layer 4. According to the protective layer 4 which contains the filler having a particle diameter of not less than 1 nm and not more than 200 nm, it is possible to improve the foil tearing on transferring this protective layer, and the durability of the image to which the protective layer is transferred, without deteriorating the glossiness of the protective layer 4.

The precise mechanism about why further improvements on the foil tearing and the durability are brought by adding the filler having a particle diameter within the above mentioned range into the protective layer 4 in addition to the "mixed type binder resin", the storage elastic modulus G' of which satisfies the above mentioned conditions 1 and 2, and which contain the "specific binder resin", in the fourth embodiment, as compared with the protective layers 4 of the first to the third embodiments are, has been not fully elucidated. However, as described above in the explanation about the protective layer 4 of the third embodiment, it is expected that the shearing of the protective layer 4 may be improved by addition of the filler having a particle diameter within the above mentioned range into the protective layer 4, and the improvement in the shearing would contribute to the improvement in the foil tearing. Further, since the particle diameter of the filler to be contained in the protective layer 4 is very small as it is not less than 1 nm and not more than 200 nm, it is expected that the filler would be less likely to cause deterioration in the glossiness of the protective layer 4, and would be improve further the foil tearing and the durability which are exerted by the above mentioned "specific binder resin" and the above mentioned "mixed type binder resin" the storage elastic modulus G' of which is defined within the prescribed range.

As the filler to be included in the protective layer 4 of the fourth embodiment, the filler as described above in the explanation for the protective layer 4 of the third embodiment can be used as-is. Thus, the detailed explanation thereof is omitted here.

There is no particular limitation about the filler content. However, when the filler content is less than 1% by weight on a basis of the total solid content of the protective layer 4, it may not be able to satisfy fully the foil tearing property. On the other hand, when it exceeds 35% by weight, there is a tendency that durability and transparency of the protective layer 4 is reduced. Therefore, considering these points, it is desirable that the filler is contained in the range of not less than 1% by weight and not more than 35% by weight on a basis of the total solid content of the protective layer 4.

The protective layer 4 may includes, optionally, any additive, for example, fluorescent whitener, UV absorbers for improving the durability, etc., in addition to the "mixed type binder resin", the storage elastic modulus G' of which is regulated so as to be in the above mentioned ranges, and which contain the "specific binder resin", and the filler having a particle diameter within the above mentioned range.

As the method for forming the protective layer 4 of the fourth embodiment, such a procedure in which "specific binder resin(s)", optionally added binder resin(s) for regulating the storage elastic modulus G', a filler having a particle diameter within the above mentioned range, and optionally added other various material are dissolved or dispersed in an appropriate solvent, so that the obtained "mixed type binder resin" contains the "specific binder resin", and the storage elastic modulus G' of the obtained "mixed type binder resin" which contains the "specific binder resin" satisfies the above mentioned conditions 1 and 2, thereby, preparing a coating liquid for protective layer; and the coating liquid thus prepared is coated on the substrate 1, (or on the exfoliate layer 3 which is optionally provided on the substrate 1), in accordance with a known procedure such as gravure printing method, screen printing method, or reverse-coating method using a gravure plate, etc., and then the coated film is dried, may be applicable.

(Receiving Layer)

As shown in FIG. 1, on the protective layer 4, a receiving layer 5 which constitutes the transfer layer 2 is provided. On the receiving layer, an image will be formed by thermal transfer from a thermal transfer sheet having a coloring agent layer in accordance with the thermal transfer method. Then, the transfer layer 2 of the intermediate transfer medium, on which the image have been thus formed, is transferred onto a transcription receiving article. As a result, a printed matter is produced. Therefore, as a material for forming the receiving layer 5, it is possible to adopt any resin material which is known as the one that can easily receive thermally-transferable colorants such as subliming dyes or thermally-fusible inks. For example, polyolefin resins such as polypropylene; halogenated resins such as polyvinyl chloride and polyvinylidene chloride; vinyl resins such as polyvinyl acetate, vinyl chloride-vinyl acetate copolymer, ethylene-vinyl acetate copolymer and polyacrylic ester; polyester resins such as polyethylene terephthalate and polybutylene terephthalate; polystyrene resins; polyamide resins; copolymer type resins of an olefin such as ethylene or propylene and another vinyl polymer; ionomer or cellulose-based resins such as cellulose diastase; polycarbonate; etc., are exemplified. In particular, vinyl chloride resin, acryl-styrene resin or a polyester resin is preferred.

When the receiving layer 5 is transferred to the transcription receiving article via an adhesive layer, adhesiveness for the receiving layer 5 itself is not necessarily required. However, if the receiving layer 5 is transferred to the transcription receiving article without the adhesive layer, it is preferable that the receiving layer 5 comprises a resin material having adhesive property, such as a vinyl chloride-vinyl acetate copolymer.

The receiving layer 5 can be formed by dissolving or dispersing a material or plural materials selected from the above-mentioned materials, and optionally in combination with various additives, into an appropriate solvent such as water or an organic solvent in order to prepare a coating liquid for the receiving layer, coating thus prepared coating liquid for the receiving layer in accordance with a known procedure such as gravure printing method, screen printing method, or reverse-coating method using a gravure plate, etc., and then drying the coated film. The receiving layer 5 is usually about 1 $g/m^2$-10 $g/m^2$ in thickness in dried state.

(Exfoliate Layer)

It is possible to provide an exfoliate layer 3 between the substrate 1 and the protective layer 4, optionally, in order to improve the exfoliation of the transfer layer 2 from the substrate 1. This exfoliate layer 3 is an optional constituent of the transfer layer 2, and it is transferred onto the transcription receiving article at the thermal transfer. However, when the exfoliate layer 3 is provided, it is possible to improve the exfoliation of transfer layer 2, and also possible to improve further the durability of the printed article due to an additive effect of this exfoliate layer 3 and the above mentioned protective layer 4. Therefore, it is preferable to provide the exfoliate layer 3.

There is no particular limitation for the exfoliate layer 3, and it may be appropriately selected and used from conventionally known materials. Usually, it may be formed by using a thermoplastic resin which includes cellulose derivatives such as ethyl cellulose, nitro cellulose, and cellulose acetate, acrylic resins such as polymethyl methacrylate, polyethyl methacrylate, polybutyl metacrylate, a polyvinyl chloride or a vinyl copolymers such as vinyl chloride-vinyl acetate copolymer, and polyvinyl butyral; or a thermosetting resin which includes saturated or unsaturated polyester resins, polyurethane resins, thermally cross-linkable epoxy-amino resins, and amino alkyd resins; or silicone wax, silicone resin, modified silicone resin, fluorine resin, modified fluorine resins, or polyvinyl alcohol. Further, in order to improve the filmy exfoliation ability of the exfoliate layer 3, it is preferable that the exfoliate layer contains a filler such as microsilica and polyethylene wax. Herein, the exfoliate layer 3 may be made of one kind of resin, or may be made of two or more kinds of resins. The exfoliate layer 3 may be formed by using a cross-linking agent such as isocyanate, a catalyst such as tin-based catalyst, aluminum-based catalyst, in addition to the resin(s) mentioned above.

The exfoliate layer 3 which is optionally provided may be formed by coating a coating liquid, which has prepared by dispersing or dissolving the above-mentioned resin into a solvent in advance, onto at least a part of the surface of the substrate 1 in accordance with a known coating procedure such as roll coating, gravure coating, and bar coating, and drying it. As the thickness of the exfoliate layer 3, it may be generally in the range of about 0.1 μm-5 μm, and preferably in the range of about 0.5 μm-2 μm.

(Plasticizer Resistive Layer)

In order to improve the plasticizer resistance of the printed matter to which the transfer layer 2 was transferred, on the constitution that the substrate 1, the protective layer 4, and the exfoliate layer 3 are provided, a plasticizer resistive layer 6 may be provided between the exfoliate layer 3 and the protective layer 4.

As the plasticizer resistive layer 6, a substance which repels the plasticizer component, or a substance which gives the plasticizer component difficulties in reaching the printed image, can be preferably used. As the above-mentioned substance which repels the plasticizer component, for instance, polyvinyl alcohol resin, polyvinyl butyral resin, polyvinyl acetal resin, polyvinyl pyrrolidone resin, etc., can be enumerated. As the substance which gives the plasticizer component difficulties in reaching the printed image, cationic resins such as cationic urethane emulsion, etc., can be enumerated. These substances may be used solely on an individual basis, or may be used as a mixture of two or more of them in combination.

In addition, with respect to polyvinyl alcohol resin, polyvinyl butyral resin, and polyvinyl acetal resin, which has been exemplified as the substance which repels the plasticizer component, it is preferable to have a saponification degree in the range of 30-100%, and more desirably, to have a saponification degree in the range of 60-100%. When the polyvinyl alcohol resin, polyvinyl butyral resin, or polyvinyl acetal resin, which has a saponification degree in the above-mentioned range, is contained in the plasticizer resistive layer 6, it can be expected to improve further the plasticizer resistance of the transfer layer 2. Herein, the "saponification degree" used in the present invention refers to the value obtained by dividing the number of moles of vinyl alcohol structures in the polymer by the number of moles of all monomers in the polymer. Further, it is preferable that the substance which repels the plasticizer component, or the substance which gives the plasticizer component difficulties in reaching the printed image is contained in the plasticizer resistive layer 6 so that the weight of the substance is in the range of 20-100% by weight on a base of the total weight of the plasticizer resistive layer 6.

Further, if necessary, it is possible to add to the plasticizer resistive layer 6, any additives, for example, lubricants, plasticizers, fillers, antistatic agents, anti-blocking agents, cross-linking agents, antioxidants, UV absorbers, light stabilizers, colorants such as dyes and pigments, fluorescent whitening agents, etc.

As the method for forming the plasticizer resistive layer 6 which is optionally provided if necessary, such a procedure in which one or more members of the substances exemplified as above, and optionally, any various material which are added if necessary, are dissolved or dispersed in an appropriate solvent in order to prepare a coating liquid for plasticizer resistive layer, and the coating liquid thus prepared is coated on the substrate 1, or on the exfoliate layer 3 which is optionally provided if necessary, and then the coated film is dried, may be applicable. Although there is no particular limitation on the thickness of the plasticizer resistive layer, the plasticizer resistive layer is usually about 0.1-50 μm in thickness after drying, and preferably, about 1-20 μm in thickness after drying.

(Transcription Receiving Article)

Onto the transcription receiving article, the transfer layer 2 of the above-mentioned intermediate transfer medium, in which the thermal transfer image has been formed, is transferred. As a result, it is possible to obtain a printed matter which excels in various durability. As the transcription receiving article to which the intermediate transfer medium according to the present invention can be applied, there is no particular limitation, and for instance, any of vinyl chloride-vinyl acetate copolymer, polyethylene terephthalate (PET), polycarbonate, natural fiber paper, coated paper, tracing paper, glass, metal, ceramics, wood, cloth, and so on, may be utilized.

(Image Forming Method)

With respect to a method for forming an image onto a receiving layer by using the thermal transfer image-receiving of the present invention, there is no particular limitation, and it is possible to form it in accordance with any conventionally known thermal transfer method.

As the thermal transfer sheet to be used on the above mentioned image formation, it is possible to use any conventionally known thermal transfer sheet, for instance, which comprises a substrate such as polyester film, and a thermal transferable color material layer which is provided on one surface of the substrate, and a back face layer which is provided on the other surface of the substrate. Now, the thermal transfer sheet will be explained.

(Substrate)

As the substrate, it is not particularly limited, as long as it is the one which has a known certain degree of heat resistance and a known certain degree of strength, and it is possible to select one arbitrarily from materials known in the art. As such a substrate, for instance, a resin film, such as polyethylene terephthalate film, 1,4-polycyclohexylene dimethylene terephthalate film, polyethylene naphthalate film, polyphenylene sulfide film, polystyrene film, polypropylene film, polysulfone film, aramide film, polycarbonate film, polyvinyl alcohol film, cellulose derivatives such as cellophane and cellulose acetate, polyethylene film, polyvinyl chloride film, nylon film, polyimide film, ionomer film, etc.; and a paper such as condenser paper, paraffin paper, synthetic paper, etc.; and a complex such as complex of paper or nonwoven fabric and resin, etc., can be enumerated.

Although the thickness of the substrate is not particularly limited, it is usually about 0.5-50 μm, and preferably, about 1.5-10 μm.

The substrate may undergo surface treatment in order to improve its adhesiveness to the adjacent layer. As the surface treatment, it is possible to apply any resin surface reforming technique known in the art, such as corona discharge treatment, flame treatment, ozone treatment, ultraviolet ray treatment, radiation treatment, roughening treatment, chemical agent's treatment, plasma treatment, grafting treatment, etc. These surface treatments may be applied singly or in combination of two or more kinds of them. In addition, if necessary, the one side or both sides of the substrate may be optionally provided with an under coating layer (primer layer).

(Thermal Transferable Color Material Layer)

When the thermal transfer sheet is a sublimation type thermal transfer sheet, sublimable dye-containing color material layers are formed as the thermal transferable color material layer. On the other hand, when the thermal transfer sheet is a heat-fusion type thermal transfer sheet, the color material layer comprises a heat-fusion composition which contains coloring agent, and becomes a color material layer containing heat-fusion ink. In addition, for instance, a color material layer containing a sublimable dye and another color material layer containing a heat-fusion type ink which comprises a heat-fusion type composition with a dye, may be provided on one continuous substrate as being frame sequentially.

As the sublimable dye, for instance, diarylmethane dyes; triarylmethane dyes; thiazole dyes; merocyanine dyes; pyrazolone dyes; methine dyes; indoaniline dyes; azomethine dyes such as acetophenone azomethine dyes, pyrazolo azomethine dyes, imidazol eazomethine dyes, imidazo azomethine dyes, and pyridone azomethine dyes; xanthene dyes; oxazine dyes; cyanostyrene dyes such as dicyanostyrene dyes and tricyanostyrene dyes; thiazine dyes; azine dyes; acridine dyes; benzeneazo dyes; azo dyes such as, pyridoneazo dyes, thiopheneazo dyes, isothiazoleazo dyes, pyrroleazo dyes, pyrazoleazo dyes, imidazoleazo dyes, thiadiazoleazo dyes, triazoleazo dyes, and disazo dyes; spiropyran dyes; indolinospiropyran dyes; fluoran dyes; rhodaminelactam dyes; naphthoquinone dyes; anthraquinone dyes; and quinophthalone dyes; etc., can be enumerated. More concretely, compounds which are exemplified in Japanese Patent Unexamined Publication JP HEI 7-149062 A (JP 1995-149062 A), and the like, can be enumerated. In the thermal transferable color material layer, it is preferable that the content of the sublimable dye is not less than 5% by weight and not more than 90% by weight, more preferably, not less than 10% by weight and not more than 70% by weight, on a base of the total solid content of the thermal transferable color material layer. When the content of the sublimable dye is less than the above mentioned range, the print density may decrease in some cases, and when the content of the sublimable dye exceeds to the above mentioned ranges, the reservation property may decrease in some cases.

As the binder resin for supporting such a dye, for instance, cellulosic resins such as ethylcellulose, hydroxyethylcellulose, ethylhydroxycellose, hydroxypropylcellulose, methylcellulose, cellulose acetate, and cellulose tributyrate; vinyl resins such as polyvinylalcohol, polyvinyl acetate, polyvinylbutyral, polyvinylacetoacetal, and polyvinylpyrrolidone; acrylic resins such as poly(meth)acrylate and poly(meta) acrylamide; polyurethane resins, polyamide resins, polyester resins, and the like. Among them, cellulosic, vinyl, acrylic, urethane, and polyester resins are preferable from the points of heat resistance and dye-transfer efficiency.

The thermal transferable color material layer may contain optionally additives such as release agent, inorganic fine particles, organic fine particles, etc. Examples of such release agent include silicone oils, polyethylene waxes, phosphate esters, etc. As the silicone oils, straight silicone oils, and modified silicone oils and their hardened forms, etc., can be enumerated. The silicone oils may be reactive ones or non-reactive ones. Examples of such inorganic fine particles include carbon black, silica, molybdenum disulfide, etc. The modified silicone oils may be classified into the reactive silicone oils and the non-reactive silicone oils. As the reactive silicone oils, for instance, amino modified-, epoxy modified-, carboxy modified-, hydroxy modified-, methacryl modified-, mercapt modified-, phenol modified-, one terminal reactive-hetero functional group modified-, etc., may be enumerated. As the non-reactive silicone oils, for instance, polyether modified-, methylstyryl modified-, alkyl modified-, higher fatty acid ester modified-, hydrophilic special modified-, higher alkoxy modified-, fluorine modified-, etc., may be enumerated. As for adding amount of the silicone oil, it is preferable to be 0.1-15% by weight, and more desirably, 0.3-10% by weight, on a base of weight of the binder. Examples of the organic fine particles as mentioned above include polyethylene waxes, etc.

The thermal transferable color material layer may be formed, for instance, by dissolving or dispersing the sublimable dye and the binder resin, and optionally, various additives if necessary, in a suitable solvent, to prepare a coating liquid for thermal transferable color material layer; coating the coating liquid on the substrate by a conventional coating method; and drying the coated liquid. As the conventional coating method, for instance, gravure printing, reverse roll coating using a gravure plate, roll coater, bar-coater, etc. may be enumerated. As the solvent, for instance, toluene, methyl ethyl ketone, ethanol, isopropyl alcohol, cyclohexanone, dimethylformamide (DMF), etc., may be enumerated.

There is no particular limitation for the thickness of the thermal transferable color material layer, and usually, the thickness is in the range of 0.2-0.5 μm.

(Back Face Layer)

In addition, for the purpose of improving the thermal resistance and giving the driving stability to the thermal head, a back face layer may be provided on the other surface of the substrate.

The back face layer may be formed by selecting and using resin(s) from the conventionally known thermoplastic resin appropriately. As the thermoplastic resin to be included in the back face layer, for instance, polyester type resins, polyacrylic ester type resins, polyvinyl acetate type resins, styrene acrylate type resins, polyurethane type resins, polyolefin type resins such as polyethylene type resins and polypropylene type resins, polystyrene type resins, polyvinyl chloride type resin, polyether type resin, polyamide type resins, polyimide type resins, polyamide imide type resin, polycarbonate type resin, polyacrylamide type resins, polyvinyl chloride type resin, polyvinyl butyral type resins, polyvinyl acetal type resins such as polyvinyl acetoacetyl type resins, etc.; and silicone modified forms of these thermoplastic resins, may be enumerated. Among them, polyamide imide type resin and silicone modified form thereof are preferably used, in consideration of the heat resistance and so on.

Further, it is preferable that the back face layer contains various additives for improving slipping property, for instance, release agent such as waxes, higher fatty acid amides, phosphoric ester compounds, metal soaps, silicone oils, surfactants, etc; organic powder such as fluorine-containing resin, etc; and inorganic powder such as silica, clay, talc, calcium carbonate; in addition to the thermoplastic resin as mentioned above. Particularly, it is preferable to contain at least one of the phosphoric ester compound and metal soap.

The back face layer may be formed by dissolving or dispersing the above mentioned the thermoplastic resin, and optionally, various additives if necessary, into a suitable solvent in order to prepare a coating liquid; coating thus prepared coating liquid onto the substrate, in accordance with a known coating procedure such as the gravure printing method, the screen printing method, the reverse roll coating method using a gravure plate, or the like; and then drying the coated liquid. It is preferable that the thickness of the back face layer is in the range of not more than 2 μm, and more desirably, in the range of 0.1 μm-1.0 μm.

EXAMPLES

Next, the present invention will be described more concretely with demonstrating examples and comparative examples. Hereinafter, unless otherwise specified, the expressions of "part(s)" and "%" means those by weight. Further, "Mn" represents the number average molecular weight, and "Tg" represents the glass transition temperature.

Example 1

Using a polyethylene terephthalate film (manufactured by Toray, Industries, Inc., Lumirror) of 12 μm in thickness as a substrate, and coating a coating liquid for exfoliate layer having the following composition onto one side of the substrate so as to obtain a film thickness of 1.0 g/m$^2$ in dried state, and then drying, an exfoliate layer was formed. After that, coating a coating liquid for protective layer 1 having the following composition onto thus formed exfoliate layer so as to obtain a film thickness of 10.0 g/m$^2$ in dried state, and then drying, a protective layer was formed. Next, coating a coating liquid for receiving layer 1 having the following composition onto thus formed protective layer so as to obtain a film thickness of 2.0 g/m$^2$ in dried state, and then drying, a receiving layer was formed. Ultimately, the intermediate transfer medium of Example 1 was prepared. Herein, all the coatings of the coating liquid for exfoliate layer, the coating liquid for protective layer 1, and the coating liquid for receiving layer were performed in accordance with gravure coating.

<Coating Liquid for Exfoliate Layer>

| | |
|---|---|
| acrylic resin (BR-87, manufactured by Mitsubishi Rayon Co., Ltd.) | 95 parts |

-continued

| | |
|---|---|
| polyester resin (Vylon 200, manufactured by TOYOBO Co., Ltd.) | 20 parts |
| toluene | 200 parts |
| MEK | 200 parts |

<Coating Liquid for Protective Layer 1>

| | |
|---|---|
| polyester resin (Mn: 16,000, Tg: 47° C.) (Vylon 600, manufactured by TOYOBO Co., Ltd.) | 20 parts |
| toluene | 40 parts |
| MEK | 40 parts |

<Coating Liquid for Receiving Layer>

| | |
|---|---|
| vinyl chloride - vinyl acetate copolymer (CNL, manufactured by Nissin Chemical Industry Co., Ltd.) | 95 parts |
| epoxy modified silicone oil (KP-1800U, manufactured by Shin-Etsu Chemical Co., Ltd.) | 5 parts |
| toluene | 200 parts |
| MEK | 200 parts |

Example 2

The same procedure as described in Example 1 was repeated, except for replacing the coating liquid for protective layer 1 with a coating liquid for protective layer 2 having the following composition, in order to prepare an intermediate transfer medium of Example 2.

<Coating Liquid for Protective Layer 2>

| | |
|---|---|
| polyester resin (Mn: 16,000, Tg: 52° C.) (Vylon GK-110, manufactured by TOYOBO Co., Ltd.) | 20 parts |
| toluene | 40 parts |
| MEK | 40 parts |

Example 3

The same procedure as described in Example 1 was repeated, except for replacing the coating liquid for protective layer 1 with a coating liquid for protective layer 3 having the following composition, in order to prepare an intermediate transfer medium of Example 3.

<Coating Liquid for Protective Layer 3>

| | |
|---|---|
| polyester resin (Mn: 11,000, Tg: 36° C.) (Vylon GK-780, manufactured by TOYOBO Co., Ltd.) | 20 parts |
| toluene | 40 parts |
| MEK | 40 parts |

Example 4

The same procedure as described in Example 1 was repeated, except for replacing the coating liquid for protective layer 1 with a coating liquid for protective layer 4 having the following composition, in order to prepare an intermediate transfer medium of Example 4.

<Coating Liquid for Protective Layer 4>

| | |
|---|---|
| polyester resin (Mn: 23,000, Tg: 47° C.) (Vylon 103, manufactured by TOYOBO Co., Ltd.) | 20 parts |
| toluene | 40 parts |
| MEK | 40 parts |

Example 5

The same procedure as described in Example 1 was repeated, except for replacing the coating liquid for protective layer 1 with a coating liquid for protective layer 5 having the following composition, in order to prepare an intermediate transfer medium of Example 5.

<Coating Liquid for Protective Layer 5>

| | |
|---|---|
| polyester resin (Mn: 10,000, Tg: 60° C.) (Vylon GK-250, manufactured by TOYOBO Co., Ltd.) | 20 parts |
| toluene | 40 parts |
| MEK | 40 parts |

Example 6

The same procedure as described in Example 1 was repeated, except for replacing the coating liquid for protective layer 1 with a coating liquid for protective layer 6 having the following composition, in order to prepare an intermediate transfer medium of Example 6.

<Coating Liquid for Protective Layer 6>

| | |
|---|---|
| polyester resin (Mn: 20,000, Tg: 60° C.) (UE3203, manufactured by UNITIKA, Ltd.) | 20 parts |
| toluene | 40 parts |
| MEK | 40 parts |

Example 7

The same procedure as described in Example 1 was repeated, except for replacing the coating liquid for protective layer 1 with a coating liquid for protective layer 7 having the following composition, in order to prepare an intermediate transfer medium of Example 7.

<Coating Liquid for Protective Layer 7>

| | |
|---|---|
| polyester resin (Mn: 18,000, Tg: 40° C.) (UE3240, manufactured by UNITIKA, Ltd.) | 20 parts |
| toluene | 40 parts |
| MEK | 40 parts |

Example 8

The same procedure as described in Example 1 was repeated, except for replacing the coating liquid for protective layer 1 with a coating liquid for protective layer 8 having the following composition, in order to prepare an intermediate transfer medium of Example 8.

<Coating Liquid for Protective Layer 8>

| | |
|---|---|
| polyester resin (Mn: 16,000, Tg: 47° C.) (Vylon 600, manufactured by TOYOBO Co., Ltd.) | 15 parts |
| polyester resin (Mn: 17,000, Tg: 67° C.) (Vylon 200, manufactured by TOYOBO Co., Ltd.) | 5 parts |
| toluene | 40 parts |
| MEK | 40 parts |

Example 9

The same procedure as described in Example 1 was repeated, except for replacing the coating liquid for protective layer 1 with a coating liquid for protective layer 9 having the following composition, in order to prepare an intermediate transfer medium of Example 9.

<Coating Liquid for Protective Layer 9>

| | |
|---|---|
| polyester resin (Mn: 16,000, Tg: 47° C.) (Vylon 600, manufactured by TOYOBO Co., Ltd.) | 10 parts |
| polyester resin (Mn: 17,000, Tg: 67° C.) (Vylon 200, manufactured by TOYOBO Co., Ltd.) | 10 parts |
| toluene | 40 parts |
| MEK | 40 parts |

Example 10

The same procedure as described in Example 1 was repeated, except for replacing the coating liquid for protective layer 1 with a coating liquid for protective layer 10 having the following composition, in order to prepare an intermediate transfer medium of Example 10.

<Coating Liquid for Protective Layer 10>

| | |
|---|---|
| polyester resin (Mn: 16,000, Tg: 47° C.) (Vylon 600, manufactured by TOYOBO Co., Ltd.) | 5 parts |
| polyester resin (Mn: 17,000, Tg: 67° C.) (Vylon 200, manufactured by TOYOBO Co., Ltd.) | 15 parts |
| toluene | 40 parts |
| MEK | 40 parts |

Example 11

The same procedure as described in Example 1 was repeated, except for replacing the coating liquid for protective layer 1 with a coating liquid for protective layer 11 having the following composition, in order to prepare an intermediate transfer medium of Example 11.

<Coating Liquid for Protective Layer 11>

| | |
|---|---|
| polyester urethane resin (Mn: 30,000, Tg: 46° C., Solid content: 33%) (UR-1350, manufactured by TOYOBO Co., Ltd.) | 60.6 parts |
| toluene | 40 parts |
| MEK | 40 parts |

Example 12

The same procedure as described in Example 1 was repeated, except for replacing the coating liquid for protective layer 1 with a coating liquid for protective layer 12 having the following composition, in order to prepare an intermediate transfer medium of Example 12.

<Coating Liquid for Protective Layer 12>

| | |
|---|---|
| polyester resin (Mn: 16,000, Tg: 47° C.) (Vylon 600, manufactured by TOYOBO Co., Ltd.) | 2 parts |
| polyester resin (Mn: 17,000, Tg: 67° C.) (Vylon 200, manufactured by TOYOBO Co., Ltd.) | 18 parts |
| toluene | 40 parts |
| MEK | 40 parts |

Comparative Example 1

The same procedure as described in Example 1 was repeated, except for replacing the coating liquid for protective layer 1 with a coating liquid for protective layer A having the following composition, in order to prepare an intermediate transfer medium of Comparative example 1.

<Coating Liquid for Protective Layer A>

| | |
|---|---|
| polyester resin (Mn: 17,000, Tg: 67° C.) (Vylon 200, manufactured by TOYOBO Co., Ltd.) | 20 parts |
| toluene | 40 parts |
| MEK | 40 parts |

Comparative Example 2

The same procedure as described in Example 1 was repeated, except for replacing the coating liquid for protective layer 1 with a coating liquid for protective layer B having the following composition, in order to prepare an intermediate transfer medium of Comparative example 2.

<Coating Liquid for Protective Layer B>

| | |
|---|---|
| polyester resin (Mn: 23,000, Tg: 67° C.) (Vylon 270, manufactured by TOYOBO Co., Ltd.) | 20 parts |
| toluene | 40 parts |
| MEK | 40 parts |

Comparative Example 3

The same procedure as described in Example 1 was repeated, except for replacing the coating liquid for protective layer 1 with a coating liquid for protective layer C having the following composition, in order to prepare an intermediate transfer medium of Comparative example 3.

<Coating Liquid for Protective Layer C>

| | |
|---|---|
| polyester resin (Mn: 13,000, Tg: 79° C.) (Vylon GK-640, manufactured by TOYOBO Co., Ltd.) | 20 parts |
| toluene | 40 parts |
| MEK | 40 parts |

Comparative Example 4

The same procedure as described in Example 1 was repeated, except for replacing the coating liquid for protective layer 1 with a coating liquid for protective layer D having the following composition, in order to prepare an intermediate transfer medium of Comparative example 4.

<Coating Liquid for Protective Layer D>

| | |
|---|---|
| polyester resin (Mn: 23,000, Tg: 4° C.) (Vylon 500, manufactured by TOYOBO Co., Ltd.) | 20 parts |
| toluene | 40 parts |
| MEK | 40 parts |

Comparative Example 5

The same procedure as described in Example 1 was repeated, except for replacing the coating liquid for protective layer 1 with a coating liquid for protective layer E having the following composition, in order to prepare an intermediate transfer medium of Comparative example 5.

<Coating Liquid for Protective Layer E>

| | |
|---|---|
| polyester resin (Mn: 28,000, Tg: −15° C.) (Vylon 550, manufactured by TOYOBO Co., Ltd.) | 20 parts |
| toluene | 40 parts |
| MEK | 40 parts |

Comparative Example 6

The same procedure as described in Example 1 was repeated, except for replacing the coating liquid for protective layer 1 with a coating liquid for protective layer F having the following composition, in order to prepare an intermediate transfer medium of Comparative example 6.

<Coating Liquid for Protective Layer F>

| | |
|---|---|
| polyester resin (Mn: 6,000, Tg: 46° C.) (Vylon GK-810, manufactured by TOYOBO Co., Ltd.) | 20 parts |
| toluene | 40 parts |
| MEK | 40 parts |

Comparative Example 7

The same procedure as described in Example 1 was repeated, except for replacing the coating liquid for protective layer 1 with a coating liquid for protective layer G having the following composition, in order to prepare an intermediate transfer medium of Comparative example 7.

<Coating Liquid for Protective Layer G>

| | |
|---|---|
| polyester resin (Mn: 6,000, Tg: 85° C.) (UE-9885, manufactured by UNITIKA, Ltd.) | 20 parts |
| toluene | 40 parts |
| MEK | 40 parts |

Comparative Example 8

The same procedure as described in Example 1 was repeated, except for replacing the coating liquid for protective layer 1 with a coating liquid for protective layer H having the following composition, in order to prepare an intermediate transfer medium of Comparative example 8.

<Coating Liquid for Protective Layer H>

| | |
|---|---|
| polyester urethane resin (Mn: 40,000, Tg: 83° C., Solid content: 30%) (UR-1400, manufactured by TOYOBO Co., Ltd.) | 66.7 parts |
| toluene | 40 parts |
| MEK | 40 parts |

Comparative Example 9

The same procedure as described in Example 1 was repeated, except for replacing the coating liquid for protective layer 1 with a coating liquid for protective layer I having the following composition, in order to prepare an intermediate transfer medium of Comparative example 9.

<Coating Liquid for Protective Layer I>

| | |
|---|---|
| polyester urethane resin (Mn: 40,000, Tg: −3° C., Solid content: 30%) (UR-3200, manufactured by TOYOBO Co., Ltd.) | 66.7 parts |
| toluene | 40 parts |
| MEK | 40 parts |

Comparative Example 10

The same procedure as described in Example 1 was repeated, except for replacing the coating liquid for protective layer 1 with a coating liquid for protective layer J having the following composition, in order to prepare an intermediate transfer medium of Comparative example 10.

<Coating Liquid for Protective Layer J>

| | |
|---|---|
| polycarbonate resin (Tg: 130° C.) (FPC-2136, manufactured by Mitsubishi Gas Chemical Company, Inc.) | 20 parts |
| toluene | 40 parts |
| MEK | 40 parts |

Comparative Example 11

The same procedure as described in Example 1 was repeated, except for replacing the coating liquid for protective layer 1 with a coating liquid for protective layer K having the following composition, in order to prepare an intermediate transfer medium of Comparative example 11.

<Coating Liquid for Protective Layer K>

| | |
|---|---|
| polyester resin (Mn: 13,000, Tg: 20° C.) (GK-140, manufactured by TOYOBO Co., Ltd.) | 20 parts |
| toluene | 40 parts |
| MEK | 40 parts |

Comparative Example 12

The same procedure as described in Example 1 was repeated, except for replacing the coating liquid for protective layer 1 with a coating liquid for protective layer L having the following composition, in order to prepare an intermediate transfer medium of Comparative example 12.

<Coating Liquid for Protective Layer L>

| | |
|---|---|
| polyester resin (Mn: 17,000, Tg: 67° C.) (Vylon 200, manufactured by TOYOBO Co., Ltd.) | 15 parts |
| polyester resin (Mn: 6,000, Tg: 46° C.) (Vylon GK-810, manufactured by TOYOBO Co., Ltd.) | 5 parts |
| toluene | 40 parts |
| MEK | 40 parts |

Comparative Example 13

The same procedure as described in Example 1 was repeated, except for replacing the coating liquid for protective layer 1 with a coating liquid for protective layer M having the following composition, in order to prepare an intermediate transfer medium of Comparative example 13.

<Coating Liquid for Protective Layer M>

| | |
|---|---|
| polyester resin (Mn: 17,000, Tg: 67° C.) (Vylon 200, manufactured by TOYOBO Co., Ltd.) | 10 parts |
| polyester resin (Mn: 6,000, Tg: 46° C.) (Vylon GK-810, manufactured by TOYOBO Co., Ltd.) | 10 parts |
| toluene | 40 parts |
| MEK | 40 parts |

Comparative Example 14

The same procedure as described in Example 1 was repeated, except for replacing the coating liquid for protective layer 1 with a coating liquid for protective layer N having the following composition, in order to prepare an intermediate transfer medium of Comparative example 14.

<Coating Liquid for Protective Layer N>

| | |
|---|---|
| polyester resin (Mn: 17,000, Tg: 67° C.) (Vylon 200, manufactured by TOYOBO Co., Ltd.) | 5 parts |
| polyester resin (Mn: 6,000, Tg: 46° C.) (Vylon GK-810, manufactured by TOYOBO Co., Ltd.) | 15 parts |
| toluene | 40 parts |
| MEK | 40 parts |

<<Durable Test (Taber Test)>>

Using HDP-600 printer (manufactured by HID), and thermal transfer sheet prepared by the following procedure, a black solid image was printed onto each individual receiving layer of the intermediate transfer media of Examples and Comparative Examples under the default condition. Then, using the same printer, each intermediate transfer medium of Examples 1-12 and Comparative examples 1-14 was superposed on a card made of polyvinyl chloride (manufactured by Dai Nippon Printing Co., Ltd), and the transfer layer (exfoliate layer, protective layer and receiving layer) of each individual intermediate transfer medium was transferred to the card. Thus, printed matters of Examples 1-12 and Comparative examples 1-14 were obtained.

The printed matters underwent wearing wherein a wear ring CS-10F was used under a load of 500 gf and was run for 1500 revolutions in total while the wear ring was ground per 250 revolutions. After wearing, the conditions of the surfaces were observed by visually, and evaluation of this test was done under the following evaluation criteria. The evaluation test results are shown in table 1.

(Preparation of Thermal Transfer Sheet)

As a substrate, polyethylene terephthalate film which underwent easy-adhesive treatment in advance, and has 4.5 μm in thickness was used. On this substrate, a liquid for forming heat resistant active layer having the following composition was coated so as to obtain a thickness of 0.8 g/m$^2$ in the dried state and then the coated liquid was dried to form a heat resistant active layer. Then, on another surface of the substrate, a liquid for forming yellow dye layer having the following composition, a liquid for forming magenta dye layer having the following composition, and a liquid for forming cyan dye layer having the following composition were coated so as to obtain each individual thickness of 0.6 g/m$^2$ in the dried state, and then the coated liquids were dried through a repeated face-by-face operation for each color in this order in order to form the respective dye layers. Ultimately, a thermal transfer sheet was prepared.

<Coating Liquid for Heat Resistance Active Layer>

| | |
|---|---|
| Polyvinyl butyral resin (S-LEC BX-1, manufactured by Sekisui Chemical Co., Ltd.) | 2.0 parts |
| Polyisocyanate (BURNOCK D750, manufactured by DIC Corporation) | 9.2 parts |
| Phosphoric ester type surfactant (PLY SURF A208N, manufactured by Dai-ichi Kogyo Seiyaku, Co., Ltd.) | 1.3 parts |
| Talc (MICRO ACE P-3, manufactured by Nippon Talc Co., Ltd.) | 0.3 parts |
| toluene | 43.6 parts |
| methyl ethyl ketone | 43.6 parts |

<Coating Liquid for Yellow Dye Layer>

| | |
|---|---|
| Dye represented by the following formula (1) | 4.0 parts |
| polyvinyl acetal resin (S-LEC KS-5, manufactured by Sekisui Chemical Co., Ltd.) | 3.5 parts |
| Polyethylene wax | 0.1 part |
| Methyl ethyl ketone | 45.0 parts |
| Toluene | 45.0 parts |

[Chem. 1]

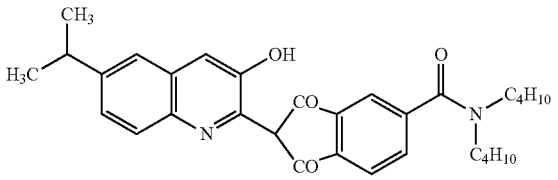

<Coating Liquid for Magenta Dye Layer>

| | |
|---|---|
| Disperse dye (Disperse Red 60) | 1.5 parts |
| Disperse dye (Disperse Violet 26) | 2.0 parts |
| polyvinyl acetal resin (S-LEC KS-5, manufactured by Sekisui Chemical Co., Ltd.) | 4.5 parts |
| Polyethylene wax | 0.1 part |
| Methyl ethyl ketone | 45.0 parts |
| Toluene | 45.0 parts |

<Coating Liquid for Cyan Dye Layer>

| | |
|---|---|
| Disperse dye (Solvent Blue 63) | 4.0 parts |
| polyvinyl acetal resin (S-LEC KS-5, manufactured by Sekisui Chemical Co., Ltd.) | 3.5 parts |
| Polyethylene wax | 0.1 part |
| Methyl ethyl ketone | 45.0 parts |
| Toluene | 45.0 parts |

<Evaluation Criteria>

◎: The image was not removed at all.

○: The image was little removed.

Δ: The image was removed to a certain degree, but there is no problem to use.

x: The printed matter (image) was fairly removed.

<<Foil Tearing (Blooming) Test>>

The foil tearing (blooming) of the printed matters of Examples 1-12 and Comparative examples 1-14 were observed by visually, and evaluation of this test was done under the following evaluation criteria. The evaluation test results are shown in table 1. Herein, the blooming means the length of the transfer layer which protruded from the boundary between the non-transferred region and the transferred region of the transfer layer, as the starting point, to the non-transferred region side.

<Evaluation Criteria>

◎: The blooming is not more than 0.1 mm.

○: The blooming is not more than 0.3 mm.

Δ: The blooming is not more than 1 mm.

x: The blooming is not more than 2 mm.

xx: The blooming is not less than 2 mm.

TABLE 1

| | Foil tearing | Durability |
|---|---|---|
| Example 1 | ◎ | ○ |
| Example 2 | ◎ | ○ |
| Example 3 | ◎ | ○ |
| Example 4 | ◎ | ○ |
| Example 5 | ○ | ○ |
| Example 6 | ○ | ◎ |
| Example 7 | ◎ | ○ |
| Example 8 | ◎ | ◎ |
| Example 9 | ◎ | ◎ |
| Example 10 | ○ | ◎ |
| Example 11 | ○ | ◎ |
| Example 12 | Δ | ◎ |
| Comparative example 1 | X | ◎ |
| Comparative example 2 | X | ◎ |
| Comparative example 3 | X | ○ |
| Comparative example 4 | ◎ | X |
| Comparative example 5 | ◎ | X |
| Comparative example 6 | ◎ | X |
| Comparative example 7 | X | X |
| Comparative example 8 | X | ○ |
| Comparative example 9 | ◎ | X |
| Comparative example 10 | XX | ◎ |
| Comparative example 11 | ◎ | X |
| Comparative example 12 | ○ | X |
| Comparative example 13 | ○ | X |
| Comparative example 14 | ◎ | X |

As is apparent from Table 1, it was confirmed that the intermediate transfer media which each had the protective layer which satisfied all of special technical features of the present invention shown excellent results in both the foil tearing and the durability. Further, it was confirmed that the examples which each contained the binder resin of the present invention in an amount of not less than 20% by weight on a base of the total solid content of the protective layer shown further improvements in the foil tearing. On the other hand, the intermediate transfer media which each had the protective layer which did not fulfill the special technical features of the present invention did not give satisfaction of both the foil tearing and the durability. Thus, the advantages of the present invention are clear. In addition, as shown in Comparative examples 12A-14A4, it was found that both the foil tearing and the durability were not satisfied, in the cases that the binder which fulfilled only the number average molecular weight (Mn) condition of the present invention, and the other binder which fulfilled only the glass transition temperature (Tg) condition of the present invention were used in combination.

Example 19

The same procedure as described in Example 1 was repeated, except for replacing the coating liquid for protective layer 1 with a coating liquid for protective layer 13 having the following composition, in order to prepare an intermediate transfer medium of Example 13. Herein, values of the storage elastic modulus G' for the binder resins in Examples 13-24 and Comparative examples 15-19 are those shown in Table 2, and the storage elastic modulus G' was calculated by using the following measurement instrument. In addition, the storage elastic modulus G' of mixed type binder resins were calculated according to the above mentioned equation for calculating the storage elastic modulus G' of mixed type binder resin.

Storage elastic modulus measurement instrument: ARES dynamic viscoelasticity measurement instrument, manufactured by TA Instrument, Japan (Advanced Rheometric Expansion System) Measurement conditions: Parallel plate 10 mm in diameter, Distortion: 1%, Amplitude (Frequency): 1 Hz, Temperature rising rate: 2° C./min. The measurement was performed by rising the measurement temperature from 30° C. to 200° C.

<Coating Liquid for Protective Layer 13>

| | |
|---|---|
| binder resin (ratio by weight: (A)/(B) = 3/7) | 20 parts |
| (A) polyester resin (GK880, manufactured by TOYOBO Co., Ltd.) | |
| (B) polyester resin (Vylon 600, manufactured by TOYOBO Co., Ltd.) | |
| toluene | 40 parts |
| MEK | 40 parts |

Example 14

The same procedure as described in Example 13 was repeated, except for replacing the coating liquid for protective layer 13 with a coating liquid for protective layer 14 having the following composition, in order to prepare an intermediate transfer medium of Example 14.

<Coating Liquid for Protective Layer 14>

| | |
|---|---|
| binder resin (ratio by weight: (A)/(B) = 1/1) | 20 parts |
| (A) polyester resin (GK880, manufactured by TOYOBO Co., Ltd.) | |
| (B) polyester resin (Vylon 600, manufactured by TOYOBO Co., Ltd.) | |
| toluene | 40 parts |
| MEK | 40 parts |

Example 15

The same procedure as described in Example 13 was repeated, except for replacing the coating liquid for protective layer 13 with a coating liquid for protective layer 15 having the following composition, in order to prepare an intermediate transfer medium of Example 15.

<Coating Liquid for Protective Layer 15>

| | |
|---|---|
| binder resin (ratio by weight: (A)/(B) = 7/3) | 20 parts |
| (A) polyester resin (GK880, manufactured by TOYOBO Co., Ltd.) | |
| (B) polyester resin (Vylon 600, manufactured by TOYOBO Co., Ltd.) | |
| toluene | 40 parts |
| MEK | 40 parts |

Example 16

The same procedure as described in Example 13 was repeated, except for replacing the coating liquid for protective layer 13 with a coating liquid for protective layer 16 having the following composition, in order to prepare an intermediate transfer medium of Example 16.

<Coating Liquid for Protective Layer 16>

| | |
|---|---|
| binder resin (ratio by weight: (A)/(B) = 7/3) | 20 parts |
| (A) polyester resin (Vylon 270, manufactured by TOYOBO Co., Ltd.) | |
| (B) polyester resin (Vylon 600, manufactured by TOYOBO Co., Ltd.) | |
| toluene | 40 parts |
| MEK | 40 parts |

Example 17

The same procedure as described in Example 13 was repeated, except for replacing the coating liquid for protective layer 13 with a coating liquid for protective layer 17 having the following composition, in order to prepare an intermediate transfer medium of Example 17.

<Coating Liquid for Protective Layer 17>

| | |
|---|---|
| binder resin (ratio by weight: (A)/(B) = 4/1) | 20 parts |
| (A) polyester resin (Vylon 200, manufactured by TOYOBO Co., Ltd.) | |
| (B) polycarbonate resin (Tg: 130° C.) (FPC-2136, manufactured by Mitsubishi Gas Chemical Company, Inc.) | |
| toluene | 40 parts |
| MEK | 40 parts |

Example 18

The same procedure as described in Example 13 was repeated, except for replacing the coating liquid for protective layer 13 with a coating liquid for protective layer 18 having the following composition, in order to prepare an intermediate transfer medium of Example 18.

<Coating Liquid for Protective Layer 18>

| | |
|---|---|
| binder resin (ratio by weight: (A)/(B)/(C) = 2/2/1) | 20 parts |
| (A) polyester resin (Vylon 200, manufactured by TOYOBO Co., Ltd.) | |
| (B) polyester resin (Vylon 600, manufactured by TOYOBO Co., Ltd.) | |

-continued

| | |
|---|---|
| (C) polycarbonate resin (Tg: 130° C.) (FPC-2136, manufactured by Mitsubishi Gas Chemical Company, Inc.) | |
| toluene | 40 parts |
| MEK | 40 parts |

Example 19

The same procedure as described in Example 13 was repeated, except for replacing the coating liquid for protective layer 13 with a coating liquid for protective layer 19 having the following composition, in order to prepare an intermediate transfer medium of Example 19.

<Coating Liquid for Protective Layer 19>

| | |
|---|---|
| binder resin (polyester resin) (GK250, manufactured by TOYOBO Co., Ltd.) | 20 parts |
| toluene | 40 parts |
| MEK | 40 parts |

Example 20

The same procedure as described in Example 13 was repeated, except for replacing the coating liquid for protective layer 13 with a coating liquid for protective layer 20 having the following composition, in order to prepare an intermediate transfer medium of Example 20.

<Coating Liquid for Protective Layer 20>

| | |
|---|---|
| binder resin (polyester resin) (Vylon 103, manufactured by TOYOBO Co., Ltd.) | 20 parts |
| toluene | 40 parts |
| MEK | 40 parts |

Example 21

The same procedure as described in Example 13 was repeated, except for changing the coating amount of the coating liquid for protective layer 13 to be 4.0 g/m$^2$ in thickness, in order to prepare an intermediate transfer medium of Example 21.

Example 22

The same procedure as described in Example 13 was repeated, except for changing the coating amount of the coating liquid for protective layer 13 to be 18.0 g/m$^2$ in thickness, in order to prepare an intermediate transfer medium of Example 22.

Example 23

The same procedure as described in Example 13 was repeated, except for changing the coating amount of the coating liquid for protective layer 13 to be 30.0 g/m$^2$ in thickness, in order to prepare an intermediate transfer medium of Example 23.

Example 24

The same procedure as described in Example 13 was repeated, except for replacing the coating liquid for protective layer 13 with a coating liquid for protective layer 21 having the following composition, in order to prepare an intermediate transfer medium of Example 24.

<Coating Liquid for Protective Layer 21>

| | |
|---|---|
| binder resin (ratio by weight: (A)/(B) = 8/2) | 20 parts |
| (A) polyester resin (Vylon GK-880, manufactured by TOYOBO Co., Ltd.) | |
| (B) polyester resin (UE-3500, manufactured by UNITIKA, Ltd.) | |
| toluene | 40 parts |
| MEK | 40 parts |

Comparative Example 15

The same procedure as described in Example 13 was repeated, except for replacing the coating liquid for protective layer 13 with a coating liquid for protective layer O having the following composition, in order to prepare an intermediate transfer medium of Comparative example 15.

<Coating Liquid for Protective Layer O>

| | |
|---|---|
| polyester resin | 20 parts |
| (GK880, manufactured by TOYOBO Co., Ltd.) | |
| toluene | 40 parts |
| MEK | 40 parts |

Comparative Example 16

The same procedure as described in Example 13 was repeated, except for replacing the coating liquid for protective layer 13 with a coating liquid for protective layer P having the following composition, in order to prepare an intermediate transfer medium of Comparative example 16.

<Coating Liquid for Protective Layer P>

| | |
|---|---|
| polymethyl methacrylate (Tg: 105° C.) | 20 parts |
| (Dianal BR80, manufactured by Mitsubishi Rayon Co., Ltd.) | |
| toluene | 40 parts |
| MEK | 40 parts |

Comparative Example 17

The intermediate transfer medium of Comparative example 10, as-is, was used as intermediate transfer medium of Comparative example 17.

Comparative Example 18

The same procedure as described in Example 13 was repeated, except for replacing the coating liquid for protective layer 13 with a coating liquid for protective layer Q having the following composition, in order to prepare an intermediate transfer medium of Comparative example 18.

<Coating Liquid for Protective Layer Q>

| | |
|---|---|
| polyester resin (Mn: 30,000, Tg: 105° C.) | 20 parts |
| (UE-3500, manufactured by UNITIKA, Ltd.) | |
| toluene | 40 parts |
| MEK | 40 parts |

Comparative Example 19

The same procedure as described in Example 13 was repeated, except for replacing the coating liquid for protective layer 13 with a coating liquid for protective layer R having the following composition, in order to prepare an intermediate transfer medium of Comparative example 19.

<Coating Liquid for Protective Layer R>

| | |
|---|---|
| binder resin (ratio by weight: (A)/(B) = 1/4) | 20 parts |
| (A) polyester resin (Vylon 200, manufactured by TOYOBO Co., Ltd.) | |
| (B) polycarbonate resin (FPC-2136, manufactured by Mitsubishi Gas Chemical Company, Inc.) | |
| toluene | 40 parts |
| MEK | 40 parts |

<<Durable Test (Taber Test)>>

In accordance with the same procedure of the durable test for Examples 1-12 and Comparative examples 1-14, printed matters were prepared and the durable test for the intermediate transfer media of Examples 13-24 and Comparative examples 15-19 were carried out. The test results are shown in table 2.

<<Foil Tearing (Blooming) Test>>

The foil tearing (blooming) of the printed matters of Examples 13-24 and Comparative example 15-19 were observed by visually, and evaluation of this test was done under the following evaluation criteria. The evaluation test results are shown in table 2.

<Evaluation Criteria>

◎: The blooming is not more than 0.5 mm.

○: The blooming is not more than 1 mm.

Δ: The blooming is not more than 2 mm.

x: The blooming is more than 2 mm and less than 5 mm.

xx: The blooming is not less than 5 mm.

<<Evaluation of Plasticizer Resistance>>

Polyvinyl chloride sheet (ARUTRON #430, manufactured by Mitsubishi Plastics, Inc.) was cut into 5 cm×5 cm in size, and the cut sheets were superposed on the printed matters of Examples 13-24 and Comparative Examples 15-19, respectively the superposed materials were kept for 8 hours under an environment of 82° C. while applying a load of 1750 g onto the individual superposed materials. After the time elapsed, test pieces were observed by visually whether the image of the printed matter migrated to the polyvinyl chloride sheet or not. Evaluation of plasticizer resistance was done under the following evaluation criteria. The evaluation results are shown in Table 2.

<Evaluation Criteria>

◎: The image did not migrate from of the printed matter to the vinyl chloride sheet at all.

○: Although the image migrated to the vinyl chloride sheet very slightly, the image on the colors of printed matter did not fade.

Δ: The image migrated to the vinyl chloride sheet slightly, and the image on the colors of printed matter faded slightly.

x: The image migrated to the vinyl chloride sheet considerably, and the colors of the image of the printed matter also faded considerably.

TABLE 2

| | Storage elastic modulus of binder resin (Pa) | | | Dura- | Foil tear- | plasti- cizer re- |
|---|---|---|---|---|---|---|
| | 35° C. | 70° C. | 90° C. | bility | ing | sistance |
| Example 13 | $4.40 \times 10^9$ | $3.66 \times 10^7$ | $3.35 \times 10^6$ | ○ | ○ | ○ |
| Example 14 | $4.32 \times 10^9$ | $1.34 \times 10^8$ | $5.66 \times 10^6$ | ○ | ○ | ◎ |
| Example 15 | $4.24 \times 10^9$ | $4.88 \times 10^8$ | $9.56 \times 10^6$ | ○ | ○ | ◎ |
| Example 16 | $4.14 \times 10^9$ | $1.64 \times 10^7$ | $4.54 \times 10^6$ | ○ | ◎ | ○ |
| Example 17 | $5.26 \times 10^9$ | $9.77 \times 10^7$ | $2.38 \times 10^7$ | ◎ | ○ | ○ |
| Example 18 | $4.90 \times 10^9$ | $4.28 \times 10^7$ | $1.31 \times 10^7$ | ◎ | ○ | ○ |
| Example 19 | $5.46 \times 10^9$ | $1.81 \times 10^7$ | $3.20 \times 10^6$ | ○ | ◎ | ○ |
| Example 20 | $4.77 \times 10^9$ | $7.55 \times 10^6$ | $3.80 \times 10^6$ | ◎ | ◎ | ◎ |
| Example 21 | $4.40 \times 10^9$ | $3.66 \times 10^7$ | $3.35 \times 10^6$ | Δ | ◎ | ○ |
| Example 22 | $4.40 \times 10^9$ | $3.66 \times 10^7$ | $3.35 \times 10^6$ | ◎ | ○ | ◎ |
| Example 23 | $4.40 \times 10^9$ | $3.66 \times 10^7$ | $3.35 \times 10^6$ | ◎ | Δ | ◎ |
| Example 24 | $1.27 \times 10^9$ | $6.25 \times 10^8$ | $9.44 \times 10^6$ | ○ | ○ | ○ |
| Comparative example 15 | $4.12 \times 10^9$ | $3.41 \times 10^9$ | $2.10 \times 10^7$ | ○ | X | ◎ |
| Comparative example 16 | $2.85 \times 10^9$ | $2.09 \times 10^9$ | $2.45 \times 10^9$ | Δ | XX | ◎ |
| Comparative example 17 | $4.76 \times 10^9$ | $3.09 \times 10^9$ | $3.43 \times 10^9$ | ◎ | XX | Δ |
| Comparative example 18 | $1.17 \times 10^7$ | $7.05 \times 10^5$ | $3.86 \times 10^5$ | X | ◎ | X |
| Comparative example 19 | $4.88 \times 10^9$ | $1.30 \times 10^9$ | $9.90 \times 10^8$ | ◎ | XX | Δ |

As is apparent from Table 2, it was confirmed that the intermediate transfer media which each had the protective layer which contained the binder resin, the storage elastic modulus G' of which at 35° C. and at 70° C.-90° C. were within the range of the present invention, shown excellent results in both the foil tearing and the durability. Further, it was found that they also excelled in plasticizer resistance. On the other hand, the intermediate transfer media which each had the protective layer which contained a binder resin, the storage elastic modulus G' of which at 35° C. and at 70° C.-90° C. were out of the range of the present invention, did not give satisfaction of both the foil tearing and the durability.

Example 25

Using a polyethylene terephthalate film (manufactured by Toray, Industries, Inc., Lumirror) of 12 μm in thickness as a substrate, and coating the coating liquid for exfoliate layer having the above mentioned composition onto one side of the substrate so as to obtain a film thickness of 1.0 g/m$^2$ in dried state, and then drying, an exfoliate layer was formed. After that, coating a coating liquid for protective layer 22 having the following composition onto thus formed exfoliate layer so as to obtain a film thickness of 4 μm in dried state, and then drying, a protective layer was formed. Next, coating a coating liquid for receiving layer having the above mentioned composition onto thus formed protective layer so as to obtain a film thickness of 2.0 g/m$^2$ in dried state, and then drying, a receiving layer was formed. Ultimately, the intermediate transfer medium of Example 25 was prepared. Herein, all the coatings of the coating liquid for exfoliate layer, the coating liquid for protective layer, and the coating liquid for receiving layer were performed in accordance with gravure coating.

<Coating Liquid for Protective Layer 22>

| | |
|---|---|
| polyester resin (Mn: 17,000)<br>(Vylon 200, manufactured by TOYOBO Co., Ltd.) | 80 parts |
| Acrylic particles<br>(MP300, particle diameter: 100 nm, manufactured by Soken Chemical & Engineering Co., Ltd.) | 20 parts |
| MEK | 400 parts |

Example 26

The same procedure as described in Example 25 was repeated, except for replacing the coating liquid for protective layer 22 with a coating liquid for protective layer 23 having the following composition, in order to prepare an intermediate transfer medium of Example 26.

<Coating Liquid for Protective Layer 23>

| | |
|---|---|
| polyester resin (Mn: 17,000)<br>(Vylon 200, manufactured by TOYOBO Co., Ltd.) | 80 parts |
| Colloidal calcium carbonate<br>(Neolight SP, particle diameter: 80 nm, manufactured by Takehara Kagaku Kogyo Co., Ltd.) | 20 parts |
| MEK | 400 parts |

Example 27

The same procedure as described in Example 25 was repeated, except for replacing the coating liquid for protective layer 22 with a coating liquid for protective layer 24 having the following composition, in order to prepare an intermediate transfer medium of Example 27.

<Coating Liquid for Protective Layer 24>

| | |
|---|---|
| polyester resin (Mn: 17,000)<br>(Vylon 200, manufactured by TOYOBO Co., Ltd.) | 80 parts |
| Colloidal calcium carbonate<br>(Neolight SS, particle diameter: 40 nm, manufactured by Takehara Kagaku Kogyo Co., Ltd.) | 20 parts |
| MEK | 400 parts |

Example 28

The same procedure as described in Example 25 was repeated, except for replacing the coating liquid for protective layer 22 with a coating liquid for protective layer 25 having the following composition, in order to prepare an intermediate transfer medium of Example 28.

<Coating Liquid for Protective Layer 25>

| | |
|---|---|
| polyester resin (Mn: 17,000)<br>(Vylon 200, manufactured by TOYOBO Co., Ltd.) | 80 parts |
| Silica<br>(637238, particle diameter: 10-20 nm, manufactured by SIGMA-ALDRICH Corp.) | 20 parts |
| MEK | 400 parts |

Example 29

The same procedure as described in Example 25 was repeated, except for replacing the coating liquid for protective layer 22 with a coating liquid for protective layer 26 having the following composition, in order to prepare an intermediate transfer medium of Example 29.

<Coating Liquid for Protective Layer 26>

| | |
|---|---|
| polyester resin (Mn: 17,000)<br>(Vylon 200, manufactured by TOYOBO Co., Ltd.) | 80 parts |
| Silica<br>(634182, particle diameter: <160 nm, manufactured by SIGMA-ALDRICH Corp.) | 20 parts |
| MEK | 400 parts |

Example 30

The same procedure as described in Example 25 was repeated, except for replacing the coating liquid for protective layer 22 with a coating liquid for protective layer 27 having the following composition, in order to prepare an intermediate transfer medium of Example 30.

<Coating Liquid for Protective Layer 27>

| | |
|---|---|
| polyester resin (Mn: 17,000)<br>(Vylon 200, manufactured by TOYOBO Co., Ltd.) | 80 parts |
| titanium oxide<br>(TTO-51, particle diameter: 10 nm-30 nm, manufactured by Ishihara Sangyo Kaisha, Ltd.) | 20 parts |
| MEK | 400 parts |

Example 31

The same procedure as described in Example 25 was repeated, except for replacing the coating liquid for protective layer 22 with a coating liquid for protective layer 28 having the following composition, in order to prepare an intermediate transfer medium of Example 31.

<Coating Liquid for Protective Layer 28>

| | |
|---|---|
| polyester resin (Mn: 17,000)<br>(Vylon 200, manufactured by TOYOBO Co., Ltd.) | 95 parts |
| Acrylic particles<br>(MP300, particle diameter: 100 nm, manufactured by Soken Chemical & Engineering Co., Ltd.) | 5 parts |
| MEK | 400 parts |

Example 32

The same procedure as described in Example 25 was repeated, except for replacing the coating liquid for protective layer 22 with a coating liquid for protective layer 29 having the following composition, in order to prepare an intermediate transfer medium of Example 32.

<Coating Liquid for Protective Layer 29>

| | |
|---|---|
| polyester resin (Mn: 17,000)<br>(Vylon 200, manufactured by TOYOBO Co., Ltd.) | 90 parts |
| Acrylic particles<br>(MP300, particle diameter: 100 nm, manufactured by Soken Chemical & Engineering Co., Ltd.) | 10 parts |
| MEK | 400 parts |

Example 33

The same procedure as described in Example 25 was repeated, except for replacing the coating liquid for protective layer 22 with a coating liquid for protective layer 30 having the following composition, in order to prepare an intermediate transfer medium of Example 33.

<Coating Liquid for Protective Layer 30>

| | |
|---|---|
| polyester resin (Mn: 17,000)<br>(Vylon 200, manufactured by TOYOBO Co., Ltd.) | 60 parts |
| Acrylic particles<br>(MP300, particle diameter: 100 nm, manufactured by Soken Chemical & Engineering Co., Ltd.) | 40 parts |
| MEK | 400 parts |

Example 34

The same procedure as described in Example 25 was repeated, except for replacing the coating liquid for protective layer 22 with a coating liquid for protective layer 31 having the following composition, in order to prepare an intermediate transfer medium of Example 34.

<Coating Liquid for Protective Layer 31>

| | |
|---|---|
| polyester resin (Mn: 17,000)<br>(Vylon 200, manufactured by TOYOBO Co., Ltd.) | 99 parts |
| Acrylic particles<br>(MP300, particle diameter: 100 nm, manufactured by Soken Chemical & Engineering Co., Ltd.) | 1 parts |
| MEK | 400 parts |

Example 35

The same procedure as described in Example 25 was repeated, except for replacing the coating liquid for protective layer 22 with a coating liquid for protective layer 32 having the following composition, in order to prepare an intermediate transfer medium of Example 35.

<Coating Liquid for Protective Layer 32>

| | |
|---|---|
| polyester resin (Mn: 17,000)<br>(Vylon 200, manufactured by TOYOBO Co., Ltd.) | 50 parts |
| Acrylic particles<br>(MP300, particle diameter: 100 nm, manufactured by Soken Chemical & Engineering Co., Ltd.) | 50 parts |
| MEK | 400 parts |

Example 36

The same procedure as described in Example 25 was repeated, except for replacing the coating liquid for protective layer 22 with a coating liquid for protective layer 33 having the following composition, in order to prepare an intermediate transfer medium of Example 36.

<Coating Liquid for Protective Layer 33>

| | |
|---|---|
| polyester resin (Mn: 23,000)<br>(Vylon 103, manufactured by TOYOBO Co., Ltd.) | 80 parts |
| Acrylic particles<br>(MP300, particle diameter: 100 nm, manufactured by Soken Chemical & Engineering Co., Ltd.) | 20 parts |
| MEK | 400 parts |

Example 37

The same procedure as described in Example 25 was repeated, except for replacing the coating liquid for protective layer 22 with a coating liquid for protective layer 34 having the following composition, in order to prepare an intermediate transfer medium of Example 37.

<Coating Liquid for Protective Layer 34>

| | |
|---|---|
| polyester resin (Mn: 6,000)<br>(UE-9885, manufactured by UNITIKA, Ltd.) | 80 parts |
| Acrylic particles<br>(MP300, particle diameter: 100 nm, manufactured by Soken Chemical & Engineering Co., Ltd.) | 20 parts |
| MEK | 400 parts |

Example 38

The same procedure as described in Example 25 was repeated, except for replacing the coating liquid for protective layer 22 with a coating liquid for protective layer 35 having the following composition, in order to prepare an intermediate transfer medium of Example 38.

<Coating Liquid for Protective Layer 35>

| | |
|---|---|
| polyester resin (Mn: 17,000) (Vylon 200, manufactured by TOYOBO Co., Ltd.) | 80 parts |
| Acrylic particles (MP1451, particle diameter: 150 nm, manufactured by Soken Chemical & Engineering Co., Ltd.) | 20 parts |
| MEK | 400 parts |

Comparative Example 20

The same procedure as described in Example 25 was repeated, except for replacing the coating liquid for protective layer 22 with a coating liquid for protective layer S having the following composition, in order to prepare an intermediate transfer medium of Comparative example 20.

<Coating Liquid for Protective Layer S>

| | |
|---|---|
| polyester resin (Mn: 17,000) (Vylon 200, manufactured by TOYOBO Co., Ltd.) | 100 parts |
| MEK | 400 parts |

Comparative Example 21

The same procedure as described in Example 25 was repeated, except for replacing the coating liquid for protective layer 22 with a coating liquid for protective layer T having the following composition, in order to prepare an intermediate transfer medium of Comparative example 21.

<Coating Liquid for Protective Layer V>

| | |
|---|---|
| polyester resin (Mn: 17,000) (Vylon 200, manufactured by TOYOBO Co., Ltd.) | 80 parts |
| Acrylic particles (MP-2200, particle diameter: 350 nm, manufactured by Soken Chemical & Engineering Co., Ltd.) | 20 parts |
| MEK | 400 parts |

<<Durable Test (Taber Test)>>

In accordance with the same procedure of the durable test for Examples 1-12 and Comparative examples 1-14, printed matters were prepared and the durable test for the intermediate transfer media of Examples 25-38 and Comparative examples 20 and 21 were carried out. The test results are shown in table 3.

<<Foil Tearing (Blooming) Test>>

The foil tearing (blooming) of the printed matters of Examples 25-38 and Comparative examples 20 and 21 were observed by visually, and evaluation of this test was done under the following evaluation criteria. The evaluation test results are shown in table 3.

<Evaluation Criteria>

◎: The blooming did not occur (not more than 1 mm)

○: The blooming occurred little (not more than 2 mm)

Δ: The blooming occurred in some degree, but there is no problem in use (2 mm-5 mm)

x: The blooming occurred considerably (not less than 5 mm)

<<Evaluation of Glossiness>>

The glossiness of the printed matters of Examples 25-38 and Comparative examples 20 and 21 were observed by visually, and evaluation of this test was done under the following evaluation criteria. The evaluation test results are shown in table 3.

<Evaluation Criteria>

○: The printed matter has no surface roughness and has high glossiness.

Δ: The printed matter has surface roughness in some degree, but there is no problem in use.

x: The printed matter has considerable surface roughness and has no glossiness.

TABLE 3

| | Durability | Foil tearing | glossiness |
|---|---|---|---|
| Example 25 | ◎ | ◎ | ○ |
| Example 26 | ○ | ○ | ○ |
| Example 27 | ○ | ○ | ○ |
| Example 28 | ○ | ○ | ○ |
| Example 29 | ○ | ○ | ○ |
| Example 30 | ○ | ○ | ○ |
| Example 31 | ◎ | ○ | ○ |
| Example 32 | ◎ | ○ | ○ |
| Example 33 | ○ | ◎ | ○ |
| Example 34 | ○ | Δ | Δ |
| Example 35 | Δ | ○ | Δ |
| Example 36 | ◎ | ○ | ○ |
| Example 37 | Δ | ◎ | ○ |
| Example 38 | ◎ | ◎ | ○ |
| Comparative Example 20 | ◎ | X | ○ |
| Comparative Example 21 | X | ○ | X |

As is apparent from Table 3, it was confirmed that the intermediate transfer media of Examples which each had the protective layer which contained the filler, the particle diameter of which is not less than 1 nm and not more than 200 nm, shown excellent results in all of the foil tearing, the durability, and the glossiness. Further, it was found that the examples which each contained the filler in an amount of not less than 5% by weight and not more than 40% by weight on a base of the total solid content of the protective layer shown particularly excellent results in the foil tearing, the durability, and the glossiness. On the other hand, the intermediate transfer media of Comparative examples which each had the protective layer which did not fulfill the special technical features of the present invention did not give satisfaction of all of the foil tearing, the durability and the glossiness.

Example 39

The same procedure as described in Example 1 was repeated, except for replacing the coating liquid for protective layer 1 with a coating liquid for protective layer 36 having the following composition, in order to prepare an intermediate transfer medium of Example 39. Herein, values of the storage elastic modulus G' for the "mixed type binder resins" in Examples 39-47 and Referential example 1 are those shown in Table 4, and the storage elastic modulus G' was calculated by the same procedure as used for Examples 13-24 and Comparative examples 15-19.

<Coating Liquid for Protective Layer 36>

| | |
|---|---|
| binder resin (ratio by weight: (A)/(B) = 3/7) | 20 parts |
| (A) polyester resin (Mn: 18,000, Tg: 84° C.) | |
| (Vylon GK880, manufactured by TOYOBO Co., Ltd.) | |
| (B) polyester resin (Mn: 16,000, Tg: 47° C.) | |
| (Vylon 600, manufactured by TOYOBO Co., Ltd.) | |
| Filler (Acrylic particles) | 2.22 parts |
| (MP300, particle diameter: 100 nm, manufactured by Soken Chemical & Engineering Co., Ltd.) | |
| toluene | 40 parts |
| MEK | 40 parts |

Example 40

The same procedure as described in Example 39 was repeated, except for replacing the coating liquid for protective layer 36 with a coating liquid for protective layer 37 having the following composition and coating the coating liquid for protective layer 37 so as to obtain a thickness of 5.0 g/m$^2$ in the dried state, in order to prepare an intermediate transfer medium of Example 40.

<Coating Liquid for Protective Layer 37>

| | |
|---|---|
| binder resin (ratio by weight: (A)/(B) = 3/7) | 20 parts |
| (A) polyester resin (Mn: 18,000, Tg: 84° C.) | |
| (Vylon GK880, manufactured by TOYOBO Co., Ltd.) | |
| (B) polyester resin (Mn: 16,000, Tg: 47° C.) | |
| (Vylon 600, manufactured by TOYOBO Co., Ltd.) | |
| Filler (Acrylic particles) | 1.05 parts |
| (MP300, particle diameter: 100 nm, manufactured by Soken Chemical & Engineering Co., Ltd.) | |
| toluene | 40 parts |
| MEK | 40 parts |

Example 40

The same procedure as described in Example 39 was repeated, except for replacing the coating liquid for protective layer 36 with a coating liquid for protective layer 38 having the following composition in order to prepare an intermediate transfer medium of Example 41.

<Coating Liquid for Protective Layer 38>

| | |
|---|---|
| binder resin (ratio by weight: (A)/(B) = 3/7) | 20 parts |
| (A) polyester resin (Mn: 18,000, Tg: 84° C.) | |
| (Vylon GK880, manufactured by TOYOBO Co., Ltd.) | |
| (B) polyester resin (Mn: 16,000, Tg: 47° C.) | |
| (Vylon 600, manufactured by TOYOBO Co., Ltd.) | |
| Filler (Acrylic particles) | 5 parts |
| (MP300, particle diameter: 100 nm, manufactured by Soken Chemical & Engineering Co., Ltd.) | |
| toluene | 40 parts |
| MEK | 40 parts |

Example 42

The same procedure as described in Example 39 was repeated, except for replacing the coating liquid for protective layer 36 with a coating liquid for protective layer 39 having the following composition in order to prepare an intermediate transfer medium of Example 42.

<Coating Liquid for Protective Layer 39>

| | |
|---|---|
| binder resin (ratio by weight: (A)/(B) = 3/7) | 20 parts |
| (A) polyester resin (Mn: 18,000, Tg: 84° C.) | |
| (Vylon GK880, manufactured by TOYOBO Co., Ltd.) | |
| (B) polyester resin (Mn: 16,000, Tg: 47° C.) | |
| (Vylon 600, manufactured by TOYOBO Co., Ltd.) | |
| Filler (Silica) | 5 parts |
| (637238, particle diameter: 10 nm-20 mm, manufactured by SIGMA-ALDRICH Corp.) | |
| toluene | 40 parts |
| MEK | 40 parts |

Example 43

The same procedure as described in Example 39 was repeated, except for replacing the coating liquid for protective layer 36 with a coating liquid for protective layer 40 having the following composition in order to prepare an intermediate transfer medium of Example 43.

<Coating Liquid for Protective Layer 40>

| | |
|---|---|
| binder resin (ratio by weight: (A)/(B) = 3/7) | 20 parts |
| (A) polyester resin (Mn: 18,000, Tg: 84° C.) | |
| (Vylon GK880, manufactured by TOYOBO Co., Ltd.) | |
| (B) polyester resin (Mn: 16,000, Tg: 47° C.) | |
| (Vylon 600, manufactured by TOYOBO Co., Ltd.) | |
| Filler (Acrylic particles) | 8.57 parts |
| (MP300, particle diameter: 100 nm, manufactured by Soken Chemical & Engineering Co., Ltd.) | |
| toluene | 40 parts |
| MEK | 40 parts |

Example 44

The same procedure as described in Example 39 was repeated, except for replacing the coating liquid for protective layer 36 with a coating liquid for protective layer 41 having the following composition in order to prepare an intermediate transfer medium of Example 44.

<Coating Liquid for Protective Layer 41>

| | |
|---|---|
| binder resin (ratio by weight: (A)/(B) = 85/15) | 20 parts |
| (A) polyester resin (Mn: 23,000, Tg: 67° C.) | |
| (Vylon 270, manufactured by TOYOBO Co., Ltd.) | |
| (B) polyester resin (Mn: 16,000, Tg: 47° C.) | |
| (Vylon 600, manufactured by TOYOBO Co., Ltd.) | |
| Filler (Acrylic particles) | 2.22 parts |
| (MP300, particle diameter: 100 nm, manufactured by Soken Chemical & Engineering Co., Ltd.) | |
| toluene | 40 parts |
| MEK | 40 parts |

Example 45

The same procedure as described in Example 39 was repeated, except for replacing the coating liquid for protective layer 36 with a coating liquid for protective layer 42 having the following composition in order to prepare an intermediate transfer medium of Example 45.

<Coating Liquid for Protective Layer 42>

| | |
|---|---|
| binder resin (ratio by weight: (A)/(B) = 5/5) | 20 parts |
| (A) polyester resin (Mn: 17,000, Tg: 67° C.) | |
| (Vylon 200, manufactured by TOYOBO Co., Ltd.) | |
| (B) polyester resin (Mn: 10,000, Tg: 60° C.) | |
| (GK 250, manufactured by TOYOBO Co., Ltd.) | |
| Filler (Acrylic particles) | 3.53 parts |
| (MP300, particle diameter: 100 nm, manufactured by Soken Chemical & Engineering Co., Ltd.) | |
| toluene | 40 parts |
| MEK | 40 parts |

Example 46

The same procedure as described in Example 39 was repeated, except for replacing the coating liquid for protective layer 36 with a coating liquid for protective layer 43 having the following composition in order to prepare an intermediate transfer medium of Example 46.

<Coating Liquid for Protective Layer 43>

| | |
|---|---|
| binder resin (ratio by weight: (A)/(B) = 6/4) | 20 parts |
| (A) polyester resin (Mn: 18,000, Tg: 84° C.) | |
| (Vylon GK880, manufactured by TOYOBO Co., Ltd.) | |
| (B) polyester resin (Mn: 23,000, Tg: 47° C.) | |
| (Vylon 103, manufactured by TOYOBO Co., Ltd.) | |
| Filler (Acrylic particles) | 8.57 parts |
| (MP300, particle diameter: 100 nm, manufactured by Soken Chemical & Engineering Co., Ltd.) | |
| toluene | 40 parts |
| MEK | 40 parts |

Example 47

The same procedure as described in Example 39 was repeated, except for replacing the coating liquid for protective layer 36 with a coating liquid for protective layer 44 having the following composition in order to prepare an intermediate transfer medium of Example 47.

<Coating Liquid for Protective Layer 44>

| | |
|---|---|
| binder resin (ratio by weight: (A)/(B)/(C) = 2/2/1) | 20 parts |
| (A) polyester resin (Mn: 17,000, Tg: 67° C.) | |
| (Vylon 200, manufactured by TOYOBO Co., Ltd.) | |
| (B) polyester resin (Mn: 16,000, Tg: 47° C.) | |
| (Vylon 600, manufactured by TOYOBO Co., Ltd.) | |
| (C) polycarbonate resin | |
| (FPC-2136, manufactured by Mitsubishi Gas Chemical Company, Inc.) | |
| Filler (Acrylic particles) | 3.53 parts |
| (MP300, particle diameter: 100 nm, manufactured by Soken Chemical & Engineering Co., Ltd.) | |
| toluene | 40 parts |
| MEK | 40 parts |

Example 48

The same procedure as described in Example 39 was repeated, except for replacing the coating liquid for protective layer 36 with a coating liquid for protective layer 45 having the following composition in order to prepare an intermediate transfer medium of Example 48.

<Coating Liquid for Protective Layer 45>

| | |
|---|---|
| binder resin (ratio by weight: (A)/(B) = 5/5) | 20 parts |
| (A) polyester resin (Mn: 23,000, Tg: 47° C.) | |
| (Vylon 103, manufactured by TOYOBO Co., Ltd.) | |
| (B) polyester resin (Mn: 10,000, Tg: 60° C.) | |
| (GK 250, manufactured by TOYOBO Co., Ltd.) | |
| Filler (Acrylic particles) | 2.22 parts |
| (MP300, particle diameter: 100 nm, manufactured by Soken Chemical & Engineering Co., Ltd.) | |
| toluene | 40 parts |
| MEK | 40 parts |

Referential Example 1

The same procedure as described in Example 39 was repeated, except for replacing the coating liquid for protective layer 36 with a coating liquid for protective layer B1 having the following composition in order to prepare an/intermediate transfer medium of Referential example 1.

<Coating Liquid for Protective Layer B1>

| | |
|---|---|
| binder resin (ratio by weight: (A)/(B) = 7/3) | 20 parts |
| (A) polyester resin (Mn: 18,000, Tg: 84° C.) | |
| (Vylon GK880, manufactured by TOYOBO Co., Ltd.) | |
| (B) polyester resin (Mn: 16,000, Tg: 47° C.) | |
| (Vylon 600, manufactured by TOYOBO Co., Ltd.) | |
| Filler (Acrylic particles) | 8.57 parts |
| (MP-2200, particle diameter: 350 nm, manufactured by Soken Chemical & Engineering Co., Ltd.) | |
| toluene | 40 parts |
| MEK | 40 parts |

<<Durable Test (Taber Test)>>

In accordance with the same procedure of the durable test for Examples 1-12 and Comparative examples 1-14, printed matters were prepared and the durable test for the intermediate transfer media of Examples 39-47 and Referential example 1 were carried out. The test results are shown in table 4.

<<Foil Tearing (Blooming) Test>>

The foil tearing (blooming) of the printed matters of Examples 39-47 and Referential example 1 were evaluated with the same evaluation criteria as for Examples 13-24 and Comparative examples 15-19. The evaluation test results are shown in table 4.

<<Evaluation of Plasticizer Resistance>>

The plasticizer resistance of the printed matters of Examples 39-47 and Referential example 1 were evaluated with the same evaluation criteria as for Examples 13-24 and Comparative examples 15-19. The evaluation test results are shown in table 4.

<<Evaluation of Glossiness>>

The glossiness of the printed matters of Examples 39-47 and Referential example 1 were evaluated with the same evaluation criteria as for Examples 25-38 and Comparative examples 20 and 21. The evaluation test results are shown in table 4.

TABLE 4

| | Storage elastic modulus of binder resin (Pa) | | | Dura- | Foil tear- | plasti- cizer re- | Gloss- |
|---|---|---|---|---|---|---|---|
| | 35° C. | 70° C. | 90° C. | bility | ing | sistance | iness |
| Example 39 | $4.40 \times 10^9$ | $3.66 \times 10^7$ | $3.35 \times 10^6$ | ○ | ◎ | ○ | ○ |
| Example 40 | $4.40 \times 10^9$ | $3.66 \times 10^7$ | $3.35 \times 10^6$ | Δ | ◎ | ○ | ○ |
| Example 41 | $4.24 \times 10^9$ | $4.88 \times 10^8$ | $9.56 \times 10^6$ | ○ | ◎ | ◎ | ○ |
| Example 42 | $4.24 \times 10^9$ | $4.88 \times 10^8$ | $9.56 \times 10^6$ | ○ | ◎ | ◎ | ○ |
| Example 43 | $4.24 \times 10^9$ | $4.88 \times 10^8$ | $9.56 \times 10^6$ | Δ | ◎ | ○ | ○ |
| Example 44 | $4.06 \times 10^9$ | $2.09 \times 10^7$ | $5.73 \times 10^6$ | ○ | ◎ | ○ | ○ |
| Example 45 | $5.20 \times 10^9$ | $4.28 \times 10^7$ | $1.31 \times 10^7$ | ○ | ◎ | ○ | ○ |
| Example 46 | $4.37 \times 10^9$ | $2.96 \times 10^8$ | $1.06 \times 10^7$ | ○ | ◎ | ○ | ○ |
| Example 47 | $4.90 \times 10^9$ | $4.28 \times 10^7$ | $1.31 \times 10^7$ | ◎ | ◎ | ○ | ○ |
| Example 48 | $5.10 \times 10^9$ | $1.17 \times 10^7$ | $3.49 \times 10^6$ | ◎ | ◎ | ○ | ○ |
| Referential Example 1 | $4.24 \times 10^9$ | $4.88 \times 10^8$ | $9.56 \times 10^6$ | Δ | ○ | ○ | X |

EXPLANATION OF NUMERALS

1 - - - substrate
2 - - - transfer layer
3 - - - exfoliate layer
4 - - - protective layer
5 - - - receiving layer
6 - - - plasticizer-resistive layer
10 - - - intermediate transfer layer

The invention claimed is:

1. An intermediate transfer medium which comprises:
a substrate, a protective layer and a receiving layer which are layered on a surface of the substrate;
wherein the protective layer comprises two or more kinds of binder resins and a filler;
wherein a mixed binder resin which consists of said two or more kinds of binder resins has a storage elastic modulus G' of not less than $1.0\times10^5$ Pa and not more than $1.0\times10^9$ Pa at 70° C.-90° C., and the storage elastic modulus G' of more than $1.0\times10^9$ Pa at 35° C.;
wherein the mixed binder resin includes a binder resin having a number average molecular weight (Mn) of not less than 8,000 and not more than 30,000, and a glass transition temperature (Tg) of not less than 36° C. and not more than 60° C.; and
wherein the filler has a particle diameter of not less than 1 nm and not more than 200 nm.

2. The intermediate transfer medium according to claim 1, wherein the filler is included in an amount of not less than 1% by weight and not more than 35% by weight on a base of total solid content of the protective layer.

3. The intermediate transfer medium according to claim 1, wherein the binder resin having the number average molecular weight (Mn) of not less than 8,000 and not more than 30,000, and the glass transition temperature (Tg) of not less than 36° C. and not more than 60° C. is included in an amount of not less than 10% by weight on a base of total solid content of the mixed binder resin.

4. An intermediate transfer medium which comprises:
a substrate, a protective layer and a receiving layer which are layered on a surface of the substrate;
wherein the protective layer comprises a binder resin having a number average molecular weight (Mn) of not less than 8,000 and not more than 30,000, and a glass transition temperature (Tg) of not less than 36° C. and not more than 60° C.

5. The intermediate transfer medium according to claim 4, wherein the binder resin is included in an amount of not less than 20% by weight and not more than 100% by weight on a base of total solid content of the protective layer.

6. The intermediate transfer medium according to claim 4, wherein the binder resin is polyester or polyester urethane.

7. An intermediate transfer medium which comprises:
a substrate, a protective layer and a receiving layer which are layered on a surface of the substrate;
wherein the protective layer comprises a binder resin which is regulated so as to have a storage elastic modulus G' of not less than $1.0\times10^5$ Pa and not more than $1.0\times10^9$ Pa at 70° C.-90° C., and the storage elastic modulus G' of more than $1.0\times10^9$ Pa at 35° C.

8. The intermediate transfer medium according to claim 7, wherein the binder resin is a mixed resin which consists of 2 or more kinds of resins to be mixed mutually.

9. The intermediate transfer medium according to claim 7, wherein the binder resin is polyester resin or polyester urethane resin.

10. An intermediate transfer medium which comprises:
a substrate, a protective layer and a receiving layer which are layered on a surface of the substrate;
wherein the protective layer comprises a binder resin and a filler which has a particle diameter of not less than 1 nm and not more than 200 nm.

11. The intermediate transfer medium according to claim 10, wherein the filler is included in an amount of not less than 5% by weight and not more than 40% by weight on a base of total solid content of the protective layer.

12. The intermediate transfer medium according to claim 10, wherein the filler is an organic filler.

13. The intermediate transfer medium according to claim 2, wherein the binder resin having the number average molecular weight (Mn) of not less than 8,000 and not more than 30,000, and the glass transition temperature (Tg) of not less than 36° C. and not more than 60° C. is included in an amount of not less than 10% by weight on a base of total solid content of the mixed binder resin.

14. The intermediate transfer medium according to claim 5, wherein the binder resin is polyester or polyester urethane.

15. The intermediate transfer medium according to claim 8, wherein the binder resin is polyester resin or polyester urethane resin.

16. The intermediate transfer medium according to claim 11, wherein the filler is an organic filler.

* * * * *